US011412584B2

(12) United States Patent
Eke et al.

(10) Patent No.: US 11,412,584 B2
(45) Date of Patent: Aug. 9, 2022

(54) OVENS WITH METALLIC BELTS AND MICROWAVE LAUNCH BOX ASSEMBLIES FOR PROCESSING FOOD PRODUCTS

(71) Applicant: Alkar-RapidPak, Inc., Lodi, WI (US)

(72) Inventors: Kenneth Ian Eke, Franklin, TN (US); Graham Christopher Eke, Franklin, TN (US); Dennis Conohan, Cross Plains, WI (US); Paul Kjorlie, Deforest, WI (US); Tom Sonntag, Lodi, WI (US); Greg Campbell, Marshfield, WI (US)

(73) Assignee: Alkar-RapidPak, Inc., Lodi, WI (US)

( * ) Notice: Subject to any disclaimer, the term of this patent is extended or adjusted under 35 U.S.C. 154(b) by 908 days.

(21) Appl. No.: 16/212,300

(22) Filed: Dec. 6, 2018

(65) Prior Publication Data

US 2019/0182911 A1 Jun. 13, 2019

Related U.S. Application Data

(60) Provisional application No. 62/596,324, filed on Dec. 8, 2017.

(51) Int. Cl.
*H05B 6/64* (2006.01)
*H05B 6/78* (2006.01)
(Continued)

(52) U.S. Cl.
CPC ..... *H05B 6/687* (2013.01); *H05B 6/6432* (2013.01); *H05B 6/6476* (2013.01);
(Continued)

(58) Field of Classification Search
CPC ..... H05B 6/60; H05B 6/6402; H05B 6/6432; H05B 6/6441; H05B 6/645; H05B 6/6473;
(Continued)

(56) References Cited

U.S. PATENT DOCUMENTS 2,704,802 A 3/1955 Blass et al.
3,300,615 A 1/1967 Smith
(Continued)

FOREIGN PATENT DOCUMENTS

AU 7186187 10/1987
CA 1199978 1/1986
(Continued)

OTHER PUBLICATIONS

Tinga, Wayne R., et al. "Combination Microwave Ovens: An Innovative Design Strategy." Journal of Microwave Power and Electromagnetic Energy, 46 (4), 2012, pp. 192-205.
(Continued)

*Primary Examiner* — Hung D Nguyen

(74) *Attorney, Agent, or Firm* — Andrus Intellectual Property Law, LLP

(57) ABSTRACT

In certain examples, a food processing machine for processing a food product includes a housing defining a cavity, a conveyor with a belt comprising metal for conveying the food product through the cavity in a longitudinal direction, and a convection heating system for heating air in the cavity such that heated air heats the food product as the food product is conveyed through the cavity. A microwave launch box system is configured to emit microwave energy into the cavity in a lateral direction transverse to the longitudinal direction to thereby further heat the food product as the food product is conveyed through the cavity.

25 Claims, 32 Drawing Sheets

(51) Int. Cl.
*H05B 6/68* (2006.01)
*H05B 6/70* (2006.01)

(52) U.S. Cl.
CPC ..... *H05B 6/6485* (2013.01); *H05B 6/6494* (2013.01); *H05B 6/682* (2013.01); *H05B 6/701* (2013.01); *H05B 6/782* (2013.01)

(58) Field of Classification Search
CPC .. H05B 6/6476; H05B 6/6482; H05B 6/6484; H05B 6/6485; H05B 6/6491; H05B 6/68; H05B 6/682; H05B 6/687; H05B 6/688; H05B 6/70; H05B 6/701; H05B 6/704; H05B 6/705; H05B 6/707; H05B 6/708; H05B 6/72; H05B 6/725; H05B 6/74; H05B 6/76; H05B 6/78; H05B 6/782
USPC ..... 219/678, 679, 681, 684, 690–692, 219/695–701
See application file for complete search history.

(56) References Cited

U.S. PATENT DOCUMENTS

| | | | | |
|---|---|---|---|---|
| 3,365,562 | A | 1/1968 | Jeppson | |
| 3,430,022 | A | 2/1969 | Cougoule | |
| 3,586,821 | A | 6/1971 | Buob | |
| 3,665,141 | A | 5/1972 | Schiffmann et al. | |
| 3,704,523 | A | 12/1972 | Guerga et al. | |
| 3,767,884 | A | 10/1973 | Osepchuk et al. | |
| 3,772,491 | A | 11/1973 | Gerling | |
| 3,857,009 | A | 12/1974 | MacMaster et al. | |
| 3,858,022 | A | 12/1974 | Smith | |
| 3,909,574 | A | 9/1975 | Muller et al. | |
| 4,045,638 | A | 8/1977 | Chiang et al. | |
| 4,176,267 | A | 11/1979 | Rueggeberg | |
| 4,182,946 | A | 1/1980 | Wayne et al. | |
| 4,336,434 | A | 6/1982 | Miller | |
| 4,358,653 | A | 11/1982 | Weiss | |
| 4,409,453 | A | 10/1983 | Smith | |
| 4,458,126 | A | 7/1984 | Dills et al. | |
| 4,488,027 | A | 12/1984 | Dudley et al. | |
| 4,492,839 | A | 1/1985 | Smith | |
| 4,508,947 | A | 4/1985 | Eke | |
| 4,533,809 | A | 8/1985 | Eke | |
| 4,570,045 | A | 2/1986 | Jeppson | |
| 4,591,683 | A | 5/1986 | Eke | |
| 4,598,689 | A | 7/1986 | Eke | |
| 4,610,886 | A | 9/1986 | Buller-Colthurst | |
| 4,647,746 | A | 3/1987 | Eke | |
| 4,653,461 | A | 3/1987 | Eke | |
| 4,661,670 | A | 4/1987 | Eke | |
| 4,691,088 | A | 9/1987 | Eke | |
| 4,771,152 | A | 9/1988 | Eke | |
| 4,812,606 | A | 3/1989 | Eke | |
| 4,816,632 | A | 3/1989 | Claesson et al. | |
| 4,831,227 | A | 5/1989 | Eke | |
| 4,874,914 | A | 10/1989 | Eke | |
| 5,089,679 | A | 2/1992 | Eke | |
| 5,160,819 | A | 11/1992 | Ball et al. | |
| 5,302,793 | A | 4/1994 | Eke | |
| 5,434,391 | A | 7/1995 | Eke | |
| 5,457,303 | A | 10/1995 | Shute et al. | |
| 5,512,312 | A | 4/1996 | Forney et al. | |
| 5,742,032 | A | 4/1998 | Eke | |
| 5,945,022 | A | 8/1999 | Volpe et al. | |
| 5,958,278 | A | 9/1999 | Engebrison et al. | |
| 6,034,362 | A | 3/2000 | Alton | |
| 6,153,868 | A | 11/2000 | Marzat | |
| 6,233,841 | B1 | 5/2001 | Beach | |
| 6,274,858 | B1 | 8/2001 | Alton | |
| 6,365,885 | B1 | 4/2002 | Roy et al. | |
| 6,452,142 | B2 | 9/2002 | Eke | |
| 6,604,452 | B2 | 8/2003 | Hanson et al. | |
| 6,635,139 | B2 | 10/2003 | Bohn et al. | |
| 6,768,089 | B2 | 7/2004 | Minobe et al. | |
| 6,781,102 | B1 | 8/2004 | Proffitt et al. | |
| 6,909,077 | B2 | 6/2005 | Eke et al. | |
| 6,982,401 | B2 | 1/2006 | Hu et al. | |
| 7,012,228 | B1 | 3/2006 | Eke et al. | |
| 7,030,347 | B2 | 4/2006 | Lee et al. | |
| 7,227,109 | B2 | 6/2007 | Eke | |
| 7,432,483 | B2 * | 10/2008 | Wilson | A21B 2/00 219/700 |
| 8,101,893 | B2 | 1/2012 | Bogdan | |
| 8,893,705 | B2 | 11/2014 | McFadden | |
| 9,204,501 | B1 * | 12/2015 | Cashman | H05B 6/782 |
| 9,585,203 | B2 | 2/2017 | Sadahira et al. | |
| 9,622,298 | B2 | 4/2017 | Kimrey, Jr. | |
| 10,680,335 | B2 | 6/2020 | Bunce et al. | |
| 2006/0081620 | A1 | 4/2006 | Eke | |
| 2006/0101755 | A1 | 5/2006 | Harris | |
| 2007/0023413 | A1 | 2/2007 | Wilson | |
| 2007/0068939 | A1 | 3/2007 | Harris | |
| 2007/0137633 | A1 | 6/2007 | McFadden | |
| 2007/0194011 | A1 | 8/2007 | McFadden | |
| 2008/0190916 | A1 | 8/2008 | Beausse | |
| 2012/0199580 | A1 | 8/2012 | Zbat et al. | |
| 2013/0071527 | A1 | 3/2013 | Pesce et al. | |
| 2013/0240510 | A1 | 9/2013 | Kimrey, Jr. | |
| 2013/0320002 | A1 | 12/2013 | Miller et al. | |
| 2014/0103031 | A1 * | 4/2014 | Peelamedu | H05B 6/645 219/700 |
| 2015/0136758 | A1 | 5/2015 | Yoshino et al. | |
| 2015/0215996 | A1 | 7/2015 | Yoshida et al. | |
| 2019/0182911 | A1 | 6/2019 | Eke et al. | |

FOREIGN PATENT DOCUMENTS

| | | | |
|---|---|---|---|
| CN | 113015280 | A | 6/2021 |
| EP | 0142958 | | 5/1985 |
| EP | 0174732 | | 3/1986 |
| EP | 0243025 | | 10/1987 |
| EP | 0592255 | | 4/1994 |
| EP | 1515591 | | 3/2005 |
| EP | 2335483 | A1 | 6/2011 |
| GB | 1376744 | | 12/1974 |
| GB | 2143707 | | 2/1985 |
| GB | 2171580 | | 8/1986 |
| JP | 2003125745 | | 5/2003 |
| JP | 3960612 | | 8/2007 |
| WO | WO2014195450 | A1 | 12/2014 |
| WO | WO2019224391 | A1 | 11/2019 |
| WO | WO2019224392 | A1 | 11/2019 |

OTHER PUBLICATIONS

Eke, Kenneth I. "Single Feed Multi-Magnetron Launch System." IMPI's 48 Microwave Power Symposium, Jun. 2014.
Vollmer, Michael. "Physics of the microwave oven." Physics Education, 39 (1), Jan. 2004, pp. 74-81.
International Search Report and Written Opinion, PCT/US2018/064447, dated Mar. 1, 2019.
EP 18885985.4, European Search Report and Opinion dated Sep. 22, 2021, 7 pages.
EP 21205674 Search Report and Opinion dated Mar. 22, 2022, 8 pages.

* cited by examiner

THIS PROGRAM CALCULATES THE NUMBER OF RESONANT MODES WITHIN A 3 DIMENSIONAL CAVITY AND DETERMINES THE DOMINANT MODES WITHIN THE 27 MODE BLOCKS OVER A MANUFACTURING TOLERANCE RANGE

| WIDTH | DEPTH | HEIGHT | L | M | N | FREQ MHz | MODE BLOCKS |
|---|---|---|---|---|---|---|---|
| 1219 | 1626 | 604 | 7 | 21 | 5 | 2435 – 2476 | 27 |
| 1219 | 1626 | 604 | 5 | 22 | 5 | 2436 – 2476 | 27 |
| 1219 | 1626 | 604 | 6 | 23 | 4 | 2437 – 2473 | 27 |
| 1219 | 1626 | 604 | 3 | 24 | 4 | 2436 – 2470 | 27 |
| 1219 | 1626 | 604 | 19 | 1 | 3 | 2434 – 2474 | 27 |
| 1219 | 1626 | 604 | 8 | 23 | 3 | 2437 – 2470 | 27 |
| 1219 | 1626 | 604 | 3 | 25 | 3 | 2434 – 2466 | 27 |
| 1219 | 1626 | 604 | 16 | 15 | 2 | 2438 – 2473 | 27 |
| 1219 | 1626 | 604 | 2 | 26 | 2 | 2446 – 2475 | 27 |
| 1219 | 1626 | 604 | 1 | 26 | 2 | 2436 – 2465 | 27 |
| 1219 | 1626 | 604 | 13 | 20 | 1 | 2437 – 2469 | 27 |
| 1219 | 1626 | 604 | 11 | 22 | 1 | 2435 – 2466 | 27 |
| 1219 | 1626 | 604 | 4 | 26 | 1 | 2445 – 2473 | 27 |
| 1219 | 1626 | 604 | 13 | 15 | 5 | 2434 – 2473 | 26 |
| 1219 | 1626 | 604 | 13 | 17 | 4 | 2435 – 2468 | 26 |
| 1219 | 1626 | 604 | 17 | 13 | 2 | 2442 – 2475 | 25 |
| 1219 | 1626 | 604 | 7 | 19 | 6 | 2435 – 2475 | 25 |
| 1219 | 1626 | 604 | 15 | 14 | 4 | 2441 – 2474 | 25 |
| 1219 | 1626 | 604 | 8 | 22 | 4 | 2445 – 2476 | 25 |
| 1219 | 1626 | 604 | 6 | 24 | 3 | 2436 – 2464 | 25 |
| 1219 | 1626 | 604 | 19 | 6 | 2 | 2435 – 2470 | 25 |
| 1219 | 1626 | 604 | 10 | 23 | 1 | 2449 – 2474 | 24 |
| 1219 | 1626 | 604 | 17 | 4 | 5 | 2436 – 2472 | 24 |
| 1219 | 1626 | 604 | 1 | 23 | 5 | 2440 – 2470 | 24 |
| 1219 | 1626 | 604 | 17 | 9 | 4 | 2438 – 2473 | 24 |
| 1219 | 1626 | 604 | 19 | 2 | 3 | 2439 – 2476 | 24 |
| 1219 | 1626 | 604 | 5 | 20 | 6 | 2434 – 2471 | 24 |

| MIN. FREQ (GHz) | MAX. FREQ (GHz) | TOLERANCE (mm) | WIDTH | DEPTH | HEIGHT | FREQ. RANGE (MHz) | MODE BLOCKS |
|---|---|---|---|---|---|---|---|
| 2.400 | 2.500 | 2 | 4 | 1 | 1 | 2399 – 2447 | 27 |
| 2.400 | 2.500 | 2 | 3 | 3 | 1 | 2448 – 2497 | 27 |
| 2.400 | 2.500 | 2 | 1 | 4 | 1 | 2399 – 2447 | 27 |

FIG. 13

OVENS WITH METALLIC BELTS AND MICROWAVE LAUNCH BOX ASSEMBLIES FOR PROCESSING FOOD PRODUCTS

CROSS-REFERENCE TO RELATED APPLICATION

The present application is based on and claims priority to U.S. Provisional Patent Application No. 62/596,324 filed Dec. 8, 2017, the disclosure of which is incorporated herein by reference.

FIELD

The present disclosure relates to food processing machines, such as ovens, with metallic belts and microwave launch box assemblies for processing food products.

BACKGROUND

The following U.S. Patents are incorporated herein by reference in entirety.

U.S. Pat. No. 5,434,391 discloses a microwave oven having a food-receiving cavity the rear panel of which is apertured to provide a launch area for the entry of microwave power to the cavity from a magnetron. A metal plate is positioned in front of a launch area, a central area of the plate having apertures.

U.S. Pat. No. 6,452,142 discloses a microwave oven having an oven cavity with a wall formed with a hole covered on an external side of the wall by a metal launch box and choke plate. A metal match plate is mounted on the internal side of the wall so that the match plate and the launch box form a launch cavity for delivering microwave energy to the cavity.

U.S. Pat. No. 6,604,452 discloses a food processing system that circulates a processing medium along a circulation path having first and second segments perpendicular to food product travel along a horizontal conveyor.

U.S. Pat. No. 6,909,077 discloses a microwave oven having an oven cavity in which a launch site for delivering microwave energy into the oven cavity is provided by a hole in a wall of the cavity and a match plate. In order to improve the distribution of microwave energy in the cavity, the oven also has a second wall partially covered on its internal side by a second match plate which acts as a second resonator.

U.S. Pat. No. 7,012,228 discloses a microwave oven having a magnetron for delivering microwave power to a cavity of the oven, a rotatable phase modular, an electrical resistance heating element, and a rotatable fan for forcing air over the resistance heating element and through the cavity. The phase modulator and the fan are mounted on a common driveshaft, and a matchplate is mounted in the cavity.

U.S. Pat. No. 7,227,109 discloses an oven cavity of a microwave oven having an apertured launch wall on the external side of which a launch box is mounted so as to cover the aperture. Two three or four magnetrons supply microwave energy to the launch box, and hence into the oven cavity, via corresponding waveguides each in communication with a respective side of the launch box.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a food processing machine for processing a food product includes a housing defining a cavity, a conveyor with a belt comprising metal for conveying the food product through the cavity in a longitudinal direction, and a convection heating system for heating air in the cavity such that heated air heats the food product as the food product is conveyed through the cavity. A microwave launch box system is configured to emit microwave energy into a cavity in a lateral direction transverse to the longitudinal direction to thereby further heat the food product as the food product is conveyed through the cavity.

In certain examples, a food processing machine for processing a food product includes a housing with a cavity, a first sidewall extending in a longitudinal direction and having a first opening therein, a second sidewall opposite the first sidewall and extending in the longitudinal direction and having a second opening therein, an upstream end wall with an opening through which the food product is received into the cavity, and a downstream end wall with an opening through the food product is dispensed from the cavity. The upstream endwall and the downstream endwall each extend in a lateral direction transverse to the longitudinal direction. A conveyor with a belt comprising metal extends through the opening in the upstream end wall and the opening in the downstream end wall and is for conveying the food product through the cavity in the longitudinal direction. A convection heating system heats air in the cavity such that the heated air cooks the food product as the food product is conveyed through the cavity, and a microwave launch box system emits microwave energy into the cavity to thereby further heat the food product as the food product is conveyed through the cavity. The microwave launch box system has a first launch box assembly coupled to the first sidewall that directs microwave energy in a lateral direction through the first opening toward the second sidewall and a second launch box assembly coupled to the second sidewall that directs microwave energy in the lateral direction through the second opening and toward the first sidewall. The first launch box assembly has a choke plate coupled to the first sidewall that prevents leakage of the microwave energy from the first opening, and the second launch box assembly has a choke plate coupled to the second sidewall that prevents leakage of the microwave energy from the second opening.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

FIG. 13 a screenshot of a cavity resonance program that is configured to determine the size of the launch box assembly.

DETAILED DESCRIPTION

Figure 1:
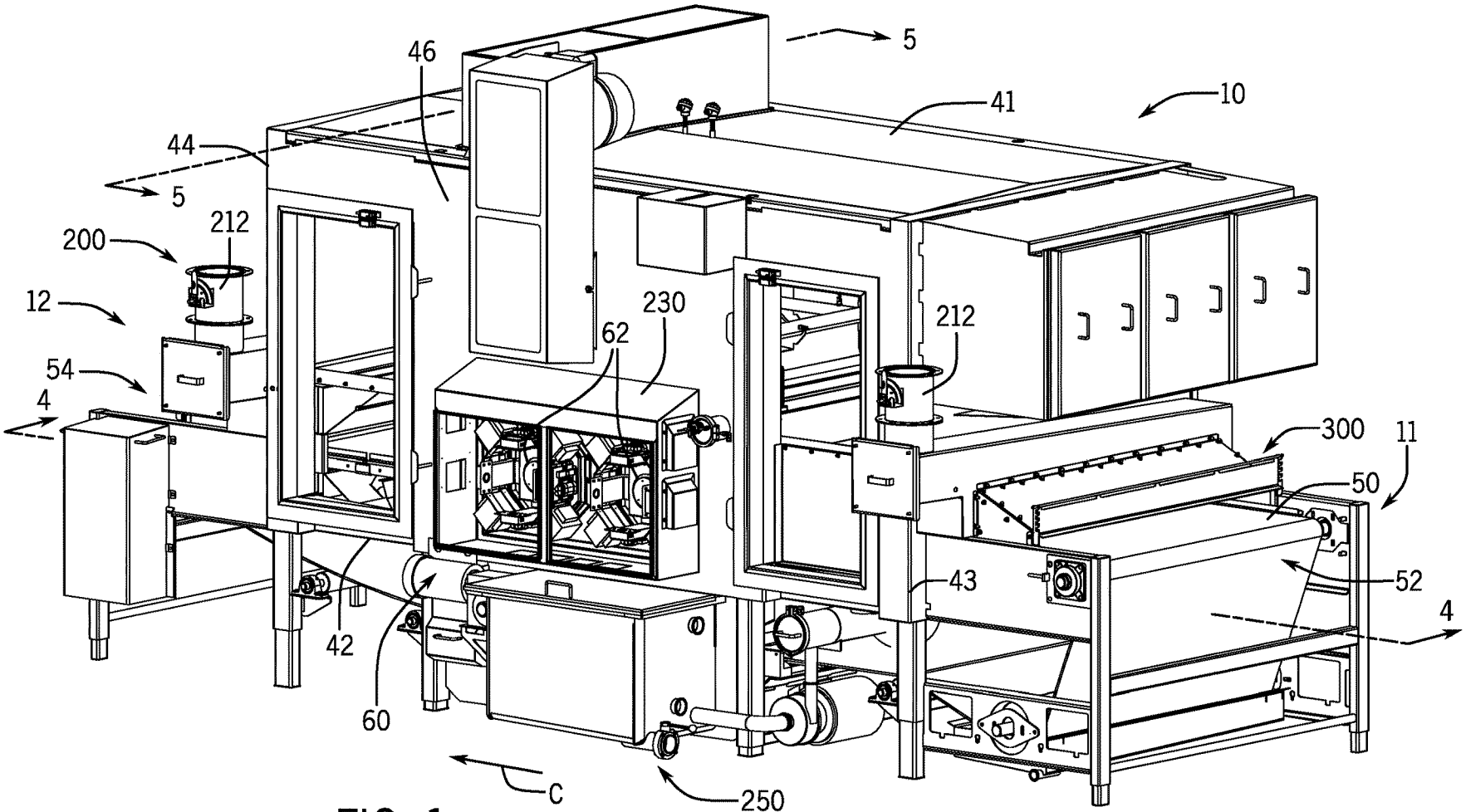
FIG. 1 is a perspective view of an example oven of the present disclosure.

In the present description, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives, and modifications are possible within the scope of the appended claims.

Conventional ovens with microwave generating devices and conveyors are known to have disadvantageous sensitivities pertaining to oven heating performance relative to load volume, such as volume of food products, food product placement on the conveyor, and/or food product properties that directly affect processing, such as cooking or heating, of the food products. Furthermore, certain conventional ovens with microwave energy generating devices and conveyors are often operated at relatively low frequencies (e.g. frequencies less than 1000 megahertz), and prior attempts at increasing microwave energy frequency and microwave energy power delivered to the oven have often resulted in unsatisfactory cooking and other disadvantages such as severe sparking and/or arcing along conveyors.

The present inventors have also recognized that conventional ovens having microwave generation devices to process food products are ineffective and overly complicated. In particular, microwave energy propagated into conventional ovens with conveyors may leak microwave energy and/or cause the microwave energy to undesirably arc, couple, and/or otherwise not process (i.e. cook) the food products conveyed through the oven. Often, conventional ovens having openings through which continuous belts are conveyed are prone to leaking microwave energy through these openings, absent the inclusion of microwave monitoring devices. The present inventors have also recognized that the natural frequency and/or a range of frequencies of the microwave chamber is modified dynamically by the varying food product properties such as food product size, shape, composition, and location within the microwave chamber as the food product passes through a microwave chamber.

The present inventors have also determined that the load sensitivity problems in conventional ovens can be directly related to coupling between microwave sources (e.g. magnetrons), which are utilized as free-running oscillators. As such, the present inventors have discovered that microwave chambers within ovens have discrete spatial energy patterns that can only be excited at the distinct natural frequencies related to the dimensions of the microwave chamber and food products in the microwave chamber. Accordingly, the present inventors have endeavored to overcome the problems described above and have thus developed, through research and experimentation, food processing machines, such as ovens, with microwave launch box systems for processing food products.

FIGS. 1-4 depict an example food processing machine, e.g. oven 10, of the present disclosure. The oven 10 includes a first, receiving end 11 and an opposite second, dispensing end 12 and has a plurality of sections or zones positioned therebetween. Namely, the oven 10 includes a receiving section 14, a first convection section 16, a launch box section 18, a second convection section 20, and a dispensing section 22 (FIG. 2) (note that the sections of the oven 10 are listed in order from the first end 11 to the second end 12).

Figure 4:
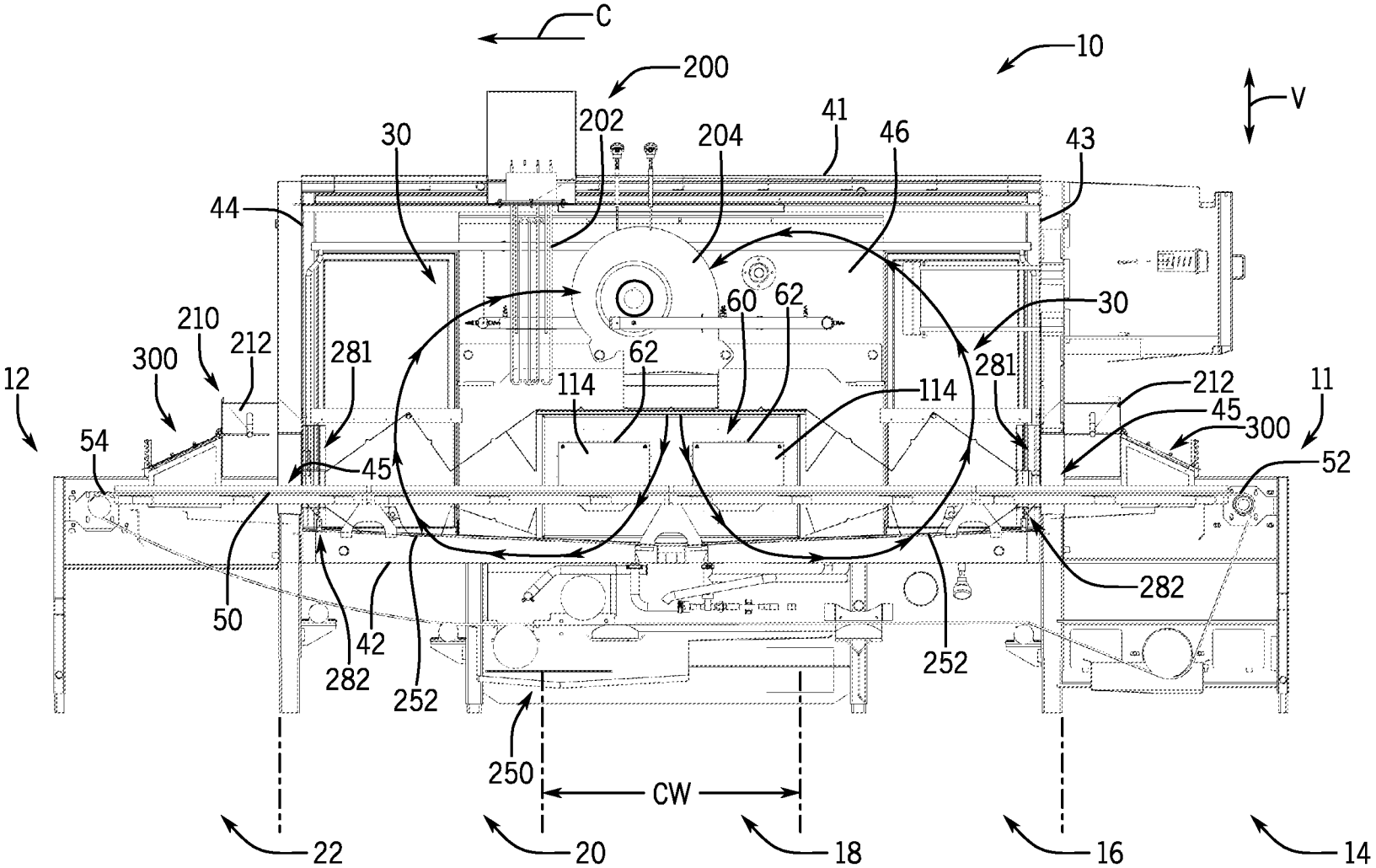
FIG. 4 a cross-sectional view of the example oven of FIG. 1 along line 4-4 on FIG. 1.

Referring specifically to FIG. 4, the oven 10 defines a cooking chamber 30 through which a conveyor with a continuous or endless woven belt 50 comprising metal is continuously conveyed (arrow C depicts the direction of motion of food product in a longitudinal direction through the oven 10). The belt 50 has a first, upstream end 52 configured to receive food products and a second, downstream end 54 configured to dispense the processed food products (e.g. heated, seared, cooked) from the oven 10. A person having ordinary skill in the art will recognize that the belt 50 can be conveyed through the oven 10 and/or the chamber 30 by a conveyor drive system (not shown) that may include motors, gears, tensioning devices, and/or other necessary devices.

Generally, the food products are received or loaded onto the belt 50 at the upstream end 52 of the belt 50 which is positioned at the receiving section 14 of the oven 10. As the belt 50 is continuously conveyed through the oven 10, the food products are moved downstream from the receiving section 14 into the chamber 30 and through the first convection section 16, the launch box section 18, and the second convection section 20 in which the food products are processed, such as cooked or heated. The processed food products exit the chamber 30 and are conveyed through the dispensing section 22 and dispensed from the downstream end 54 of the belt 50 to a separate packaging machine or secondary processing machine (not shown). Reference is made to above-incorporated U.S. Pat. No. 6,604,452 which discloses a conventional oven that generally discloses oven components and functions that may be utilized with the oven 10 of the present disclosure. Note that in some examples the food products are received from a separate food product loading machine and/or cutting machine (not shown).

The chamber 30 is generally defined by a top wall 41, a bottom wall 42, a drive or first sidewall 46, an idle or second sidewall 47, a first or upstream endwall 43, and a second or downstream endwall 44. The drive sidewall 46 is opposite the idle sidewall 47, and the sidewalls 46, 47 can include any number of launch openings 48 (described herein) that are configured to permit microwave energy to enter the chamber 30. The upstream endwall 43 is opposite the downstream endwall 44, and each endwall 43, 44 has an opening 45 through which the belt 50 extends and/or the food products are conveyed. A person having ordinary skill in the art will recognize that the endwalls 43, 44 and/or the sidewalls 46, 47 can have any number of openings which may allow other components (described herein) of the oven 10 to be coupled thereto.

The oven 10 includes a microwave launch box system 60 and a convection heating system 200 that process (e.g. cook) food products conveyed through chamber 30. As will be described herein, the microwave launch box system 60 and the convection heating system 200 are configured to function together and/or independently such the food products can be processed according to desired specifications.

Referring to FIGS. 5-8, the microwave launch box system 60 is configured to direct or propagate microwave energy into the chamber 30 at the microwave launch box section 18 (herein referred to the microwave chamber 31) to thereby process the food product being conveyed through the microwave launch box section 18 of the oven 10. The microwave energy is emitted in a lateral direction (see arrow D on FIG. 5) that is transverse to the longitudinal direction (see arrow C on FIG. 1).

The microwave launch box system 60 includes four launch box assemblies 62 coupled to the sidewalls 46, 47 at the microwave launch box section 18 of the oven 10. Two launch box assemblies 62 are positioned on each of the sidewalls 46, 47 and the launch box assemblies 62 are orientated such that the microwave energy emitted from the launch box assemblies 62 is directed into the microwave chamber 31 toward the belt 50 and/or the food products. Furthermore, the launch box assemblies 62 are positioned on the drive sidewall 46 and the idle sidewall 47 such that the launch box assemblies 62 are aligned in the vertical direction (see arrow V on FIG. 4) and longitudinal direction (see arrow C on FIG. 4) and directly across from each other (e.g. opposing launch box assemblies 62 are aligned and opposite each other on the sidewalls 46, 47) and transmit microwave energy toward each other (see FIG. 5).

A single launch box assembly 62 is described hereinbelow with reference to the drive sidewall 46. A person having ordinary skill in the art will recognize that any number of launch box assemblies 62 can be included with the oven 10. Furthermore, a person having ordinary skill in the art will recognize and each launch box assembly 62 in the microwave launch box system 60 can include or exclude any of the features described herein with reference to the single launch box assembly 62.

Figure 7:
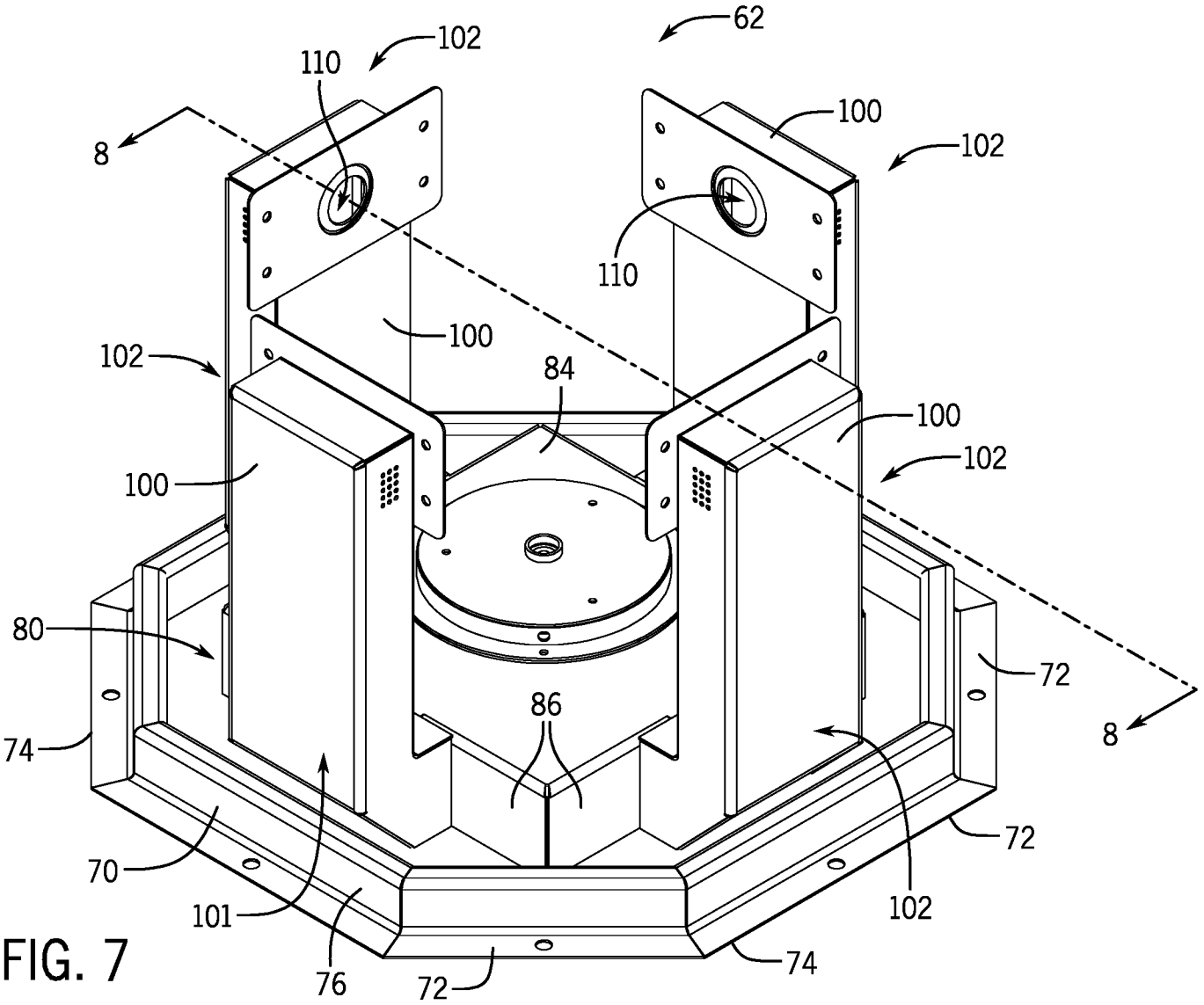
FIG. 7 is a perspective view of an example a launch box assembly.
Figure 8:
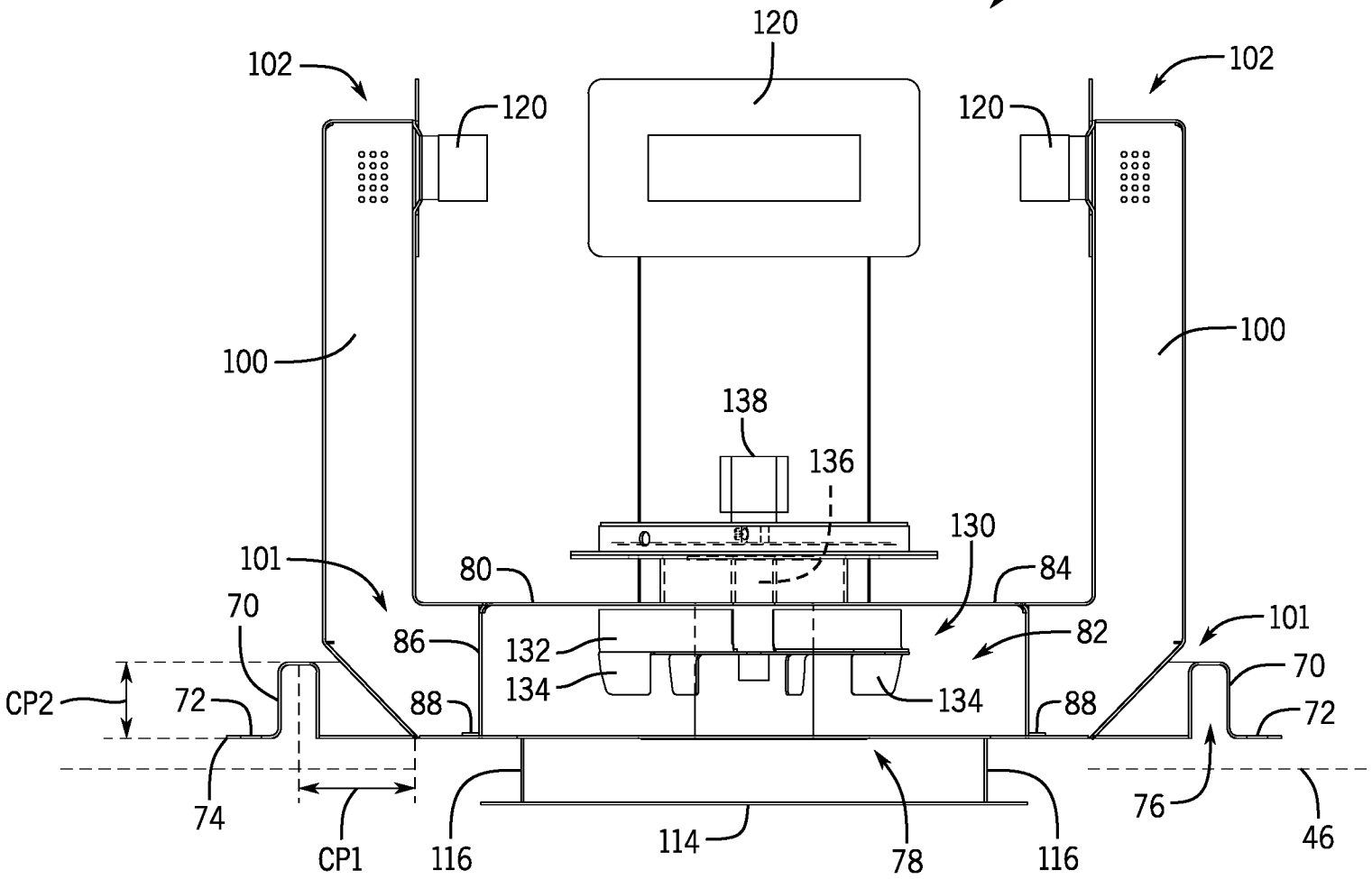
FIG. 8 is a cross-sectional view of the launch box assembly of FIG. 7 along line 8-8 on FIG. 7.

Referring specifically to FIGS. 7-8, the launch box assembly 62 includes a choke plate 70 that is coupled to the exterior surface of the drive sidewall 46. The choke plate 70 includes an attachment flange 72 that couples to the exterior surface of the drive sidewall 46, a rim 74 that defines a choke channel 76, and a launch aperture 78. The choke plate 70 is coupled to the drive sidewall 46 such that the launch aperture 78 aligns with the launch opening 48 in the drive sidewall 46. The choke plate 70 is configured to prevent microwave leakage from the launch box assembly 62 at the launch openings 48 in the sidewalls 46, 47. A person having ordinary skill in the art will recognize that the size and the shape of the launch aperture 78 of the choke plate 70 can vary (e.g. square, rectangular, octagonal) and may correspond, including impedance match, of the launch opening 48.

Figure 32:
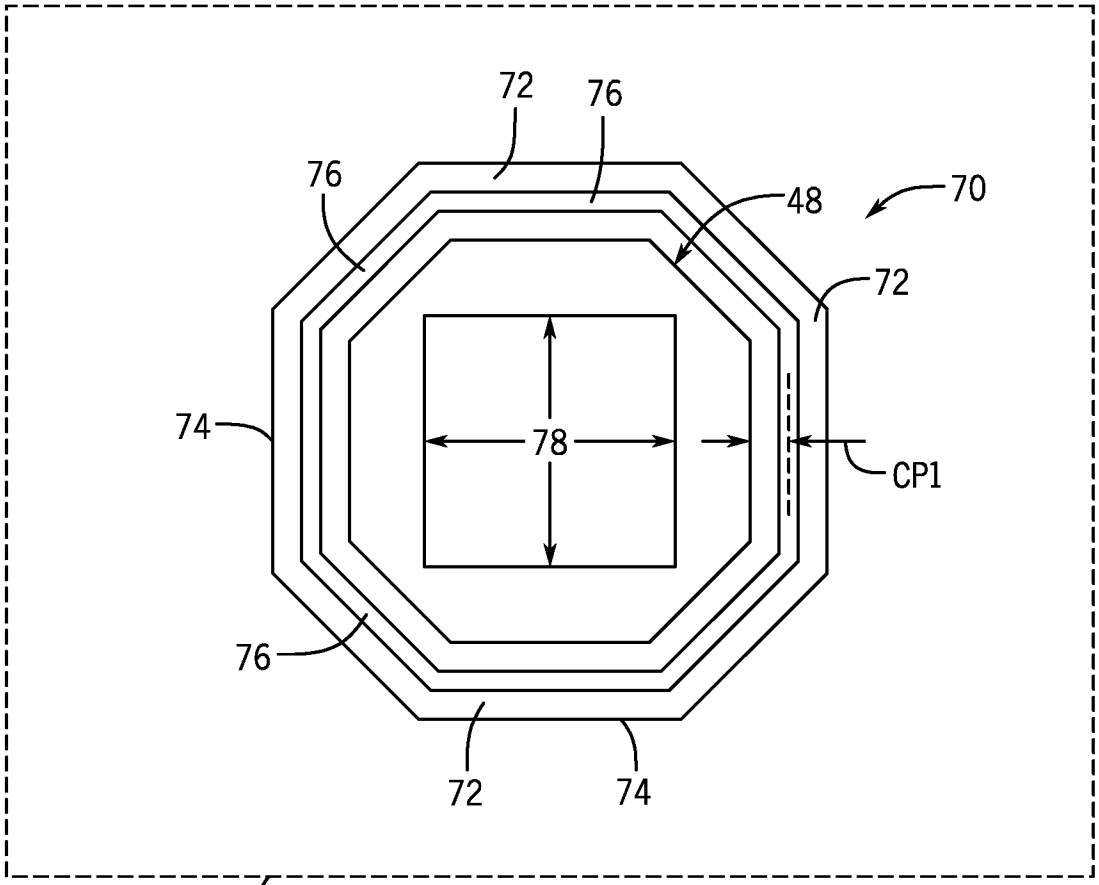
FIG. 32 is a bottom view of a choke plate of the present disclosure.

Referring specifically to FIGS. 8 and 32, the choke plate 70 is shown in greater detail. The choke channel 76 is sized and positioned relative to the launch opening 48 in the drive sidewall 46. That is, the choke channel 76 encircles the launch opening 48 and the distance from the centerline of the choke channel 76 to the edge of the launch opening 48 is a one-quarter wavelength ($\lambda/4$) or approximately 35 millimeters (see CP1). In addition, the depth of the choke plate 70 is one-quarter wavelength ($\lambda/4$) or approximately 35 millimeters (see CP2). Accordingly, the depth (CP2) of the choke plate 70 plus the distance (CP1) from the centerline of the choke channel 76 to the edge of the launch opening 48 equals a one-half wavelength ($\lambda/2$), and thereby, the choke channel forms high impedance suppression that prevents microwave energy from leaking from the choke plate 70 and/or out of the launch opening 48.

The launch box assembly 60 further includes a launch box 80 that is coupled to the choke plate 70 such that the launch box 80 covers the launch aperture 78 and defines a launch box cavity 82 that extends from a top plate 84 of the launch box 80 to the launch aperture 78. The launch box 80 includes four side plates 86 that are transverse to the top plate 84, and each side plate 86 has out-turned flanges 88 that extend transversely outwardly from the side plates 86 and are coupled to the choke plate 70. Each side plate 86 also has a side plate opening 90 (FIG. 12) configured to receive an end of a waveguide 100.

Four identical waveguides 100 (see FIG. 14) are coupled to the launch box 80 at each side plates 86. Each waveguide 100 has an interior space 104 that extends between a first end 101 that is coupled to the side plate 86 and an opposite, second end 102 that is coupled to a magnetron 120 (described herein). The first end 101 is coupled to the side plate 86 such that the interior space 104 is in communication (e.g. fluid communication) with the side plate opening 90 and the launch box cavity 82. The second end 102 of the waveguide 100 has a cutout 110. A magnetron 120 is coupled to each waveguide 100 and configured to emit or propagate microwave energy through the cutout 110 and into the interior space 104 of the waveguide 100. The magnetron 120 has an oscillating frequency of 2450 megahertz plus or minus 20 megahertz. An example magnetron 120 is commercially available from WITOL (part no. 2M463K-1500 W, water cooled). A person having ordinary skill in the art will recognize that the magnetron 120 can be coupled to any side of the waveguide 100 (e.g. the magnetron 120 can be placed on the side of the waveguide 100 that is orientated toward the center of the launch box 80 or on the opposing side of the waveguide 100 that is orientated away from the center of the launch box 80).

The launch box assembly 62 also includes a match plate 114 coupled to the oven 10 (e.g. the interior surface of the drive sidewall 46) opposite the choke plate 70 such that the match plate 114 is positioned in the microwave chamber 31. The match plate 114 includes legs 116 that project from the match plate 114 through leg holes (not shown) in the drive sidewall 46 and couple to the choke plate 70. The legs 116 permit the match plate 114 to "standoff" from the interior surface of the drive sidewall 46 and be spaced apart from the interior surface of the drive sidewall 46. The size and shape of the match plate 114 can vary and is sized be different factors of the oven 10, as is described hereinbelow.

Generally, the launch box assembly 62 is designed as an iris-isolated transducer-exciter which can house up to four magnetrons 120, and the match plate 114 acts as an oversized, non-contacting resonance plate. Through research and experimentation, the present inventors have determined the optimum dimensions for the match plate 114 as well as other elements of the launch box assembly 62 (e.g. the waveguide 100, the launch box 80, the choke plate 70) such that the application of the microwave launch box system 60 and/or the oven 10 thereby supports a number of resonant modes which are dependent on the frequency of resonance of the magnetrons.

In operation, that launch box cavity 82 operates as a transducer exciter and the microwave chamber 31 acts as a main multimode cavity. The launch box cavity 82 has a constant impedance traversing many frequencies with the industrial, scientific, and medical radio band (ISM band) and the operating function of the launch box cavity 82 does not change as the launch box cavity 82 remains an "unloaded" cavity (e.g. the launch box cavity 82 has no food products loaded therein) at all times of operation. That is, the launch box cavity 82 isolates the magnetron(s) 120 from the oven impedance, modulates the phase angle of the load plane, sets a standing wave ratio (SWR), and excites both amplitude and phase travelling around the perimeter of the match plate 114 which in turn provides energy transfer from the launch box cavity 82 to the varying mode patterns within the microwave chamber 31.

As is well known in the art, the following equation determines the resonant modes:

$$f = \frac{c}{2}\sqrt{\left(\frac{L}{W}\right)^2 + \left(\frac{M}{D}\right)^2 + \left(\frac{N}{H}\right)^2}$$

In the above equation, f is the frequency; c is the velocity of light; W, D, and H are the width, depth, and height dimensions of the launch box cavity 82; and L, M, and N are the corresponding integers of the resonant modes. By using the above equation and through research and experimentation, the launch box 80 and the match plate 114 support resonant modes 411, 141, and 331 within the ISM band giving rise to twenty-seven mode blocks over the frequency range of 2435-2475 megahertz. Note that a mode pattern of 411 means that there are four resonances in the width dimension, one resonance in the depth dimension, and one resonance in the height dimension and similarly, a mode pattern of 141 means that there is one resonance in the width direction, four resonances in the depth dimension, and one resonance in the height dimension. Based on the above described resonant mode patterns, the present inventors have determined that a microwave chamber 31 having dimensions of width of 1219 millimeters (mm) CW (FIG. 4), depth of 1626 mm CD (FIG. 5), and height of 604 mm CH (FIG. 5), produces resonant mode patterns far in excess of those within the launch box 80.

Figure 9:
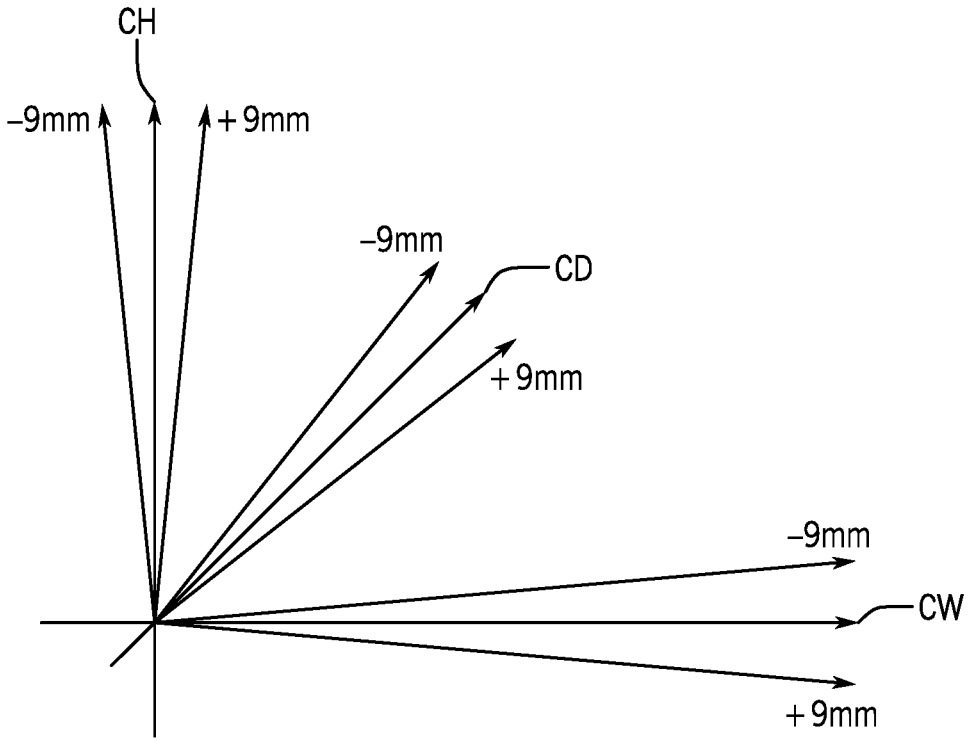
FIG. 9 is a diagram of manufacturing tolerances of a microwave chamber.
Figure 10:
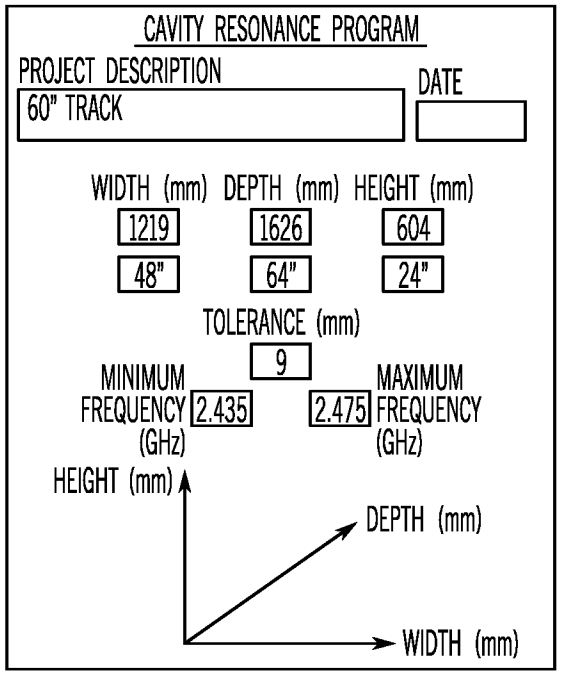
FIG. 10 is a screenshot of a cavity resonance program that is configured to determine the number of 27-mode blocks.

In order to determine the mode patterns supported in the microwave chamber 31, the dimensions of the microwave chamber 31 (width of 1219 millimeters CW, depth of 1626 millimeters CD, and height of 604 millimeters CH) and the manufacturing tolerances of the microwave chamber 31 are factored into the specialized design equation for the microwave launch box system 60 and/or the oven 10 of the present disclosure. In the case of the present example, the manufacturing tolerance for each dimension of the microwave chamber 31 is +/−9.0 millimeters. As is shown graphically in the FIG. 9, each dimension has three variables and hence multiplication of the three variable together yields twenty-seven mode blocks (3×3×3=27). Next, referring to FIG. 10, the number of resonant modes within a three-dimensional cavity (e.g. the microwave chamber 31) are determined and the dominant modes within the twenty-seven modes blocks when factoring for the manufacturing tolerance range are determined. Accordingly, the present inventors have determined that there are thirteen dominant modes in the twenty-seven mode blocks are supported and utilized.

Figure 11:
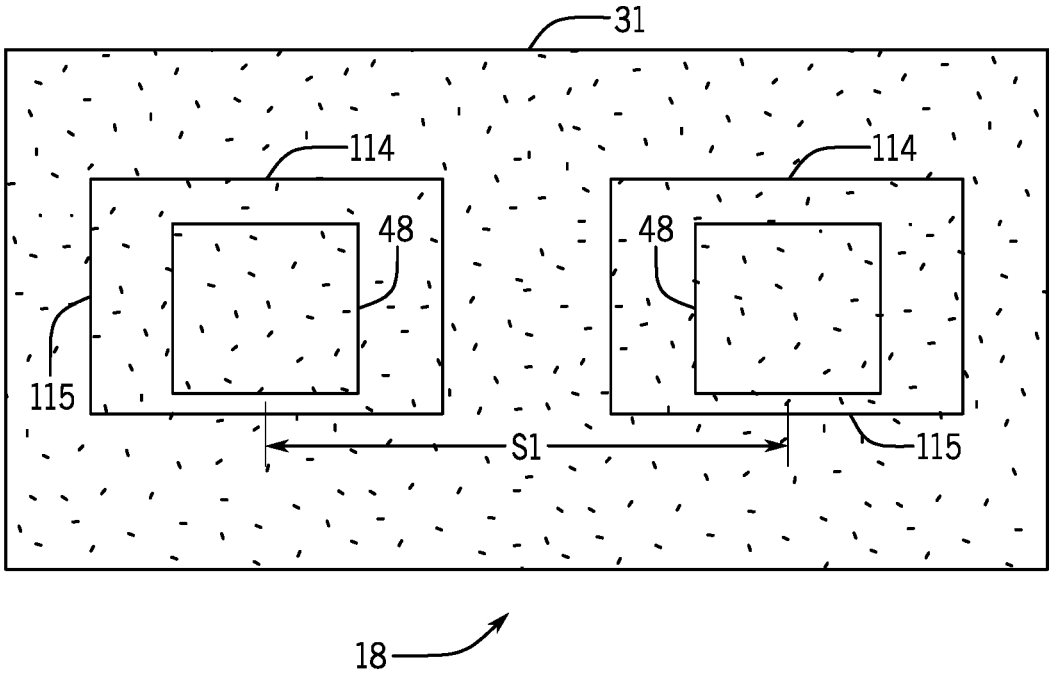
FIG. 11 is an example resonant mode plot showing different microwave resonance as dots.

Based on the modes supported within the microwave chamber 31, the dimensions of the match plate 114 are determined by use of a microwave mode plot (FIG. 11). FIG. 11 depicts a side view of the microwave launch box section 18 (i.e. the drive sidewall 46 at the microwave launch box section 18) and the launch opening 48. Each resonant mode (see FIG. 10) is plotted and the dimensions of the match plate 114 are configured such that perimeter 115 of the match plate excites the maximum number of resonant modes along the perimeter 115. That is, the size and/or shape (e.g. dimensions) of the match plate 114 is the most effectively sized match plate 114 to thereby couple the desired resonant modes together.

Figure 12:
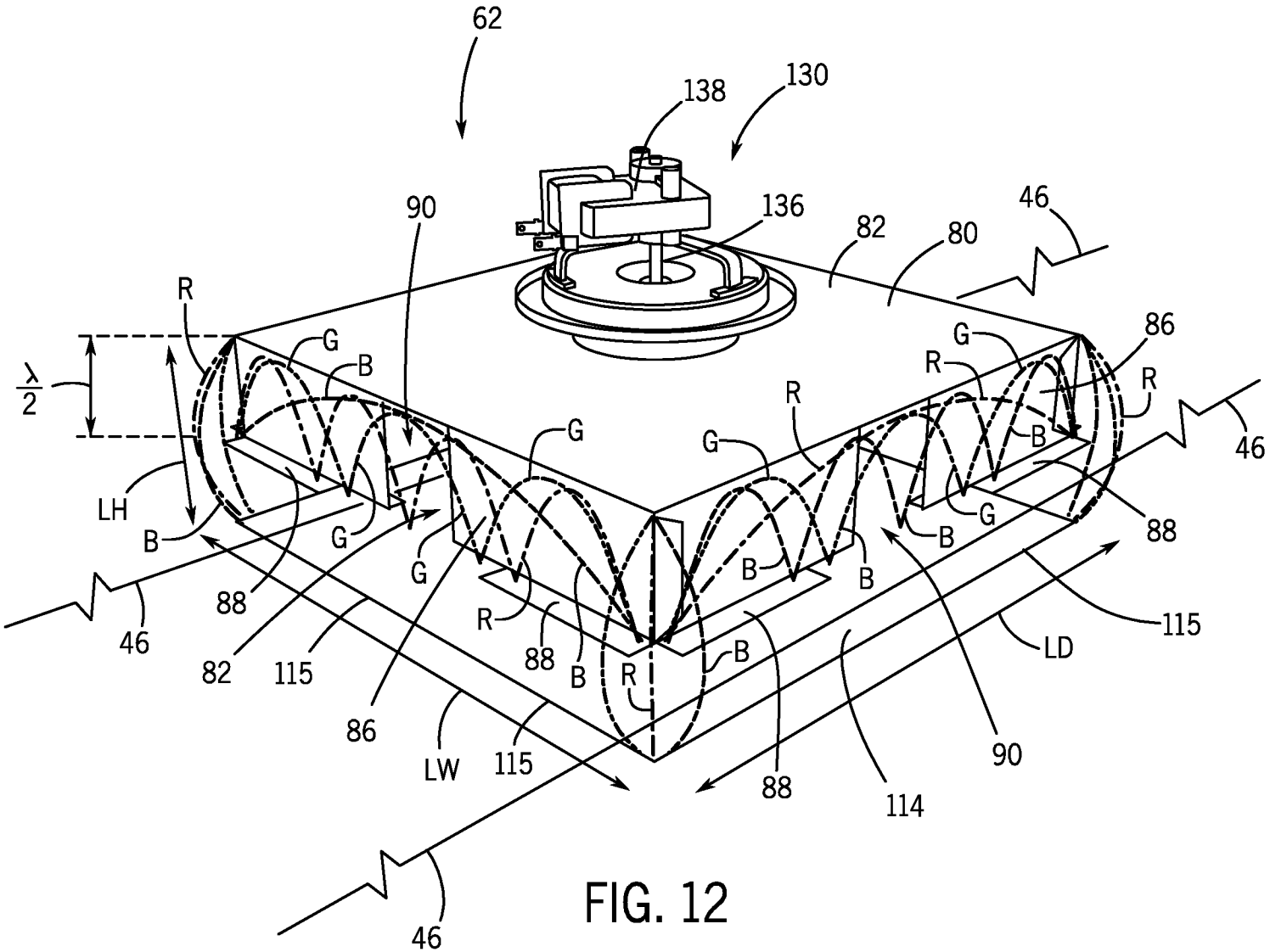
FIG. 12 is an example launch box assembly with example microwave resonant mode waves graphically depicted thereon.

The supported resonant mode patterns and the dimensions of the microwave chamber 31 and the match plate 114 are utilized to set the dimensions of the launch box 80, the launch box cavity 82, and/or the waveguides 100. Specifically, through research and experimentation, the present inventors have determined that the dimensions of the launch box 80 to accommodate the resonant modes within the microwave chamber 31 include: width of 306 millimeters (LW), depth of 306 millimeters (LD), and height of 112 millimeters (LH) (see FIGS. 12-13). By using the above-described equation that governs the resonant modes and factoring in a manufacturing tolerance of +/−2.0 millimeters for the dimensions (e.g. height, width, and length) of the launch box 80 (see FIG. 13), the present inventors have determined that the launch box 80 supports mode patterns of 411, 141, and 331 that resonate within the launch box cavity 82. Referring to FIG. 12, the resonant modes, 411 (shown as line labeled R), 141 (shown as line labeled B) and 331 (shown as line labeled G), are graphically represented relative to the launch box 80 and the match plate 114. As is well known in the art, the E-field (electric field or voltage) and H-field (magnetic field or current) components of the microwaves are 90 degrees out-of-phase, and as such both the 411 (E-field) resonant mode and the 141 (H-field) resonant mode will propagate evenly in the launch box cavity 82 while the 331 resonant mode evenly adds intensity to both the E-field and the H-field. As a result, the height of each resonant mode has a maxima located at 56 millimeters or one-half wavelength (λ/2) (note that 56 millimeters is also the location at which the launch box cavity 82 is adjacent to the launch opening 48 in the drive sidewall 46) due to the E-field and the H-field having the same vertical magnitude. The sum of the resonant voltages, e.g. the E-field, propagates through the oven impedance (Zo) from the drive sidewall 46 and/or the launch aperture 78 to the match plate 114 giving rise to a decreased intensity due to reflective impedance. Conversely, the magnetic current, e.g. H-field, passes unimpeded down the drive sidewall 46 within the microwave launch box section 18 and thereby propagates across the belt 50. As such, the microwave chamber 31 within the microwave launch box section 18 experiences conductive H-field heating combined with reduced E-field heating across the belt 50.

Figure 14:
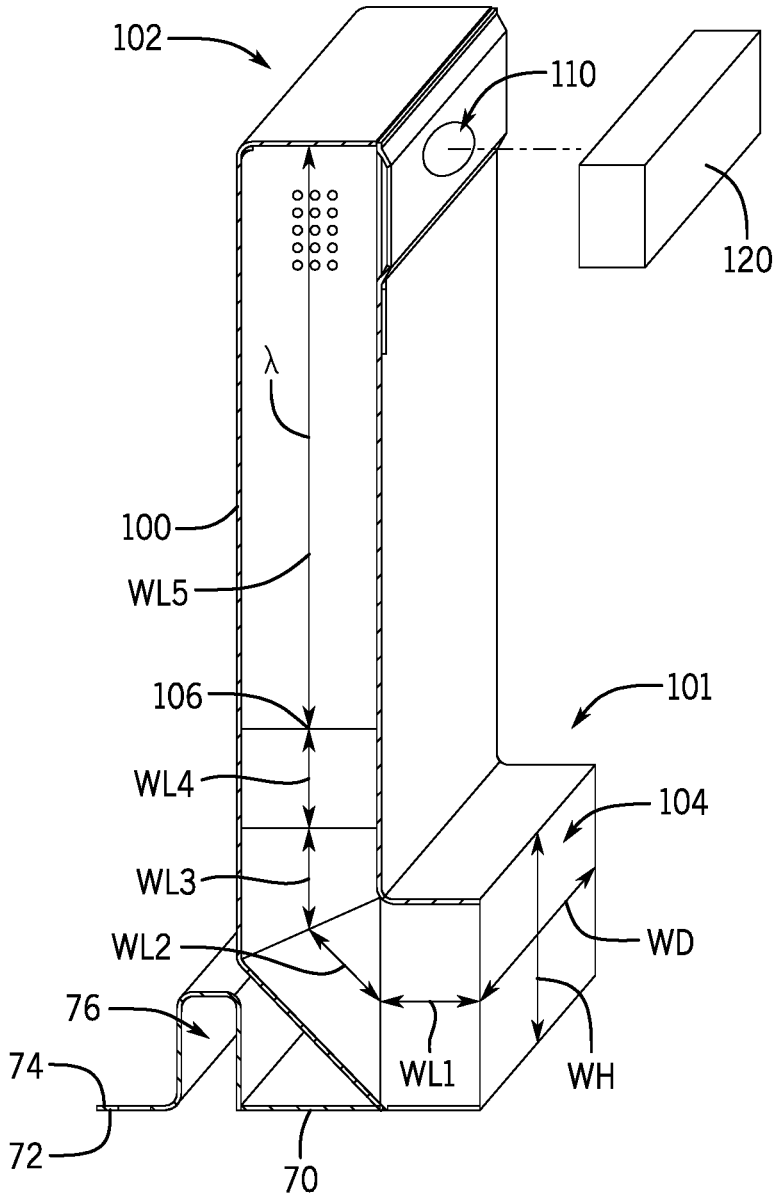
FIG. 14 is a perspective view of an example waveguide of the present disclosure.

Excitation of the mode patterns described above propagate into the launch box 80 and create frequency trajectories (as observed on a conventional Network Analyzer) that produce a standing wave ratio (SWR) of 4.0. Referring specifically to FIG. 14, the interior space 104 of the waveguide 100 has a height of 55.0 mm WH and a width of 97.0 mm WD. The waveguide 100 has a 90 degree bend such that the length of the interior space 104 is divided into five section: 27.0 mm WL1, 27.0 mm WL2, 27.0 mm WL3, 27.0 mm WL4, and 158.0 mm WL5. In operation, the frequency of each magnetron 120 then propagates microwaves through the cutout 110 into the interior space 104 of the waveguide 100. Each of the four waveguides has a wavelength of 158 millimeters, and the second end 102 of the waveguide 100 and an intermediate position 106 one wavelength (λ) e.g. 158 millimeters, from the second end 102 act as short circuit backwall spacing for the magnetrons. Accordingly, microwaves do not leak from the second end 102 of the waveguide 100. The present inventors have recognized that the fifth section of the waveguide 100 (WL5) should be a multiple of the wavelength (λ) (e.g. 2 wavelengths or 316 millimeters) such that a short circuit is positioned between the fifth section and fourth section (i.e. the intermediate position 106) of the waveguide 100. A person having ordinary skill in the art will recognize that the length of the fifth section (WL5) of the waveguide 100 can vary.

To accommodate the wide frequency range of 2435 to 2475 megahertz, an impedance stirrer or modulator 130 (see FIG. 8) is coupled to the launch box 80 and is configured to rotate within the launch box cavity 82 to thereby vary the impedance of the microwaves propagating in the launch box cavity 82. The impedance modulator 130 has a rotor 132 having metal blades 134 driven by a driveshaft 136 and a drive motor 138. The impedance modulator 130 is configured to change the phase angles of the load plane of the magnetron 120 and sets the preferred SWR which in turn sets the frequency of oscillation of the magnetron 120.

Figure 15:
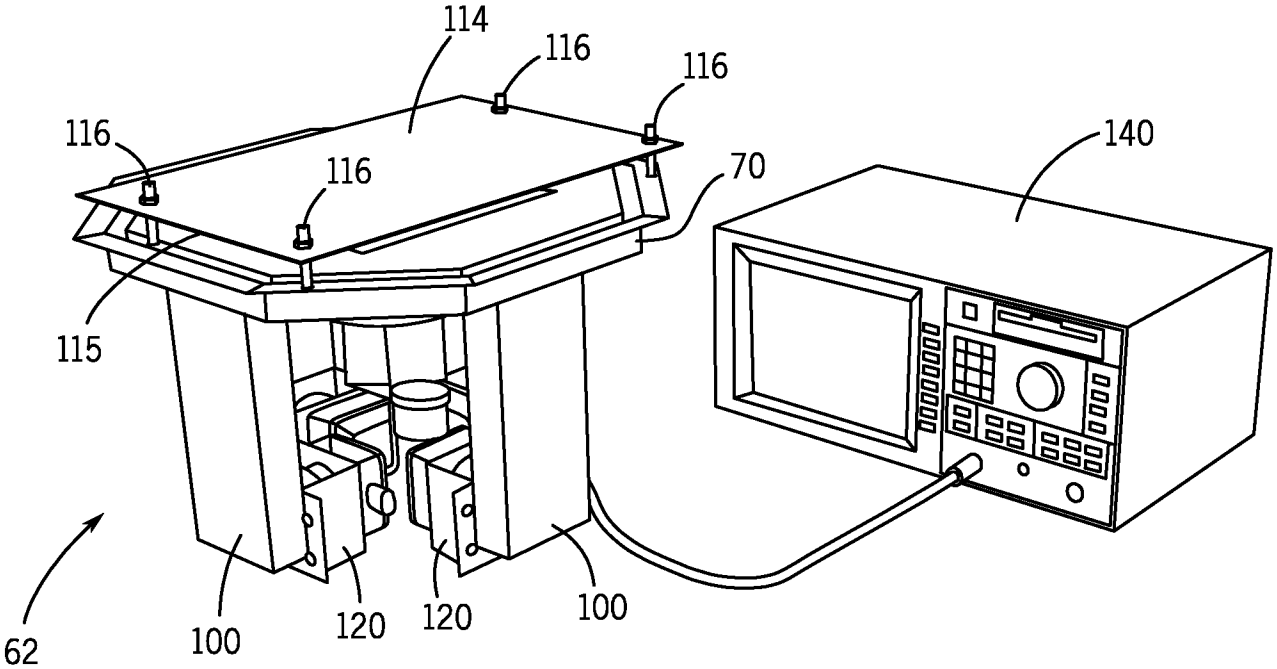
FIG. 15 is an example launch box assembly and network analyzer. The launch box assembly is depicted decoupled from the oven.
Figure 16:
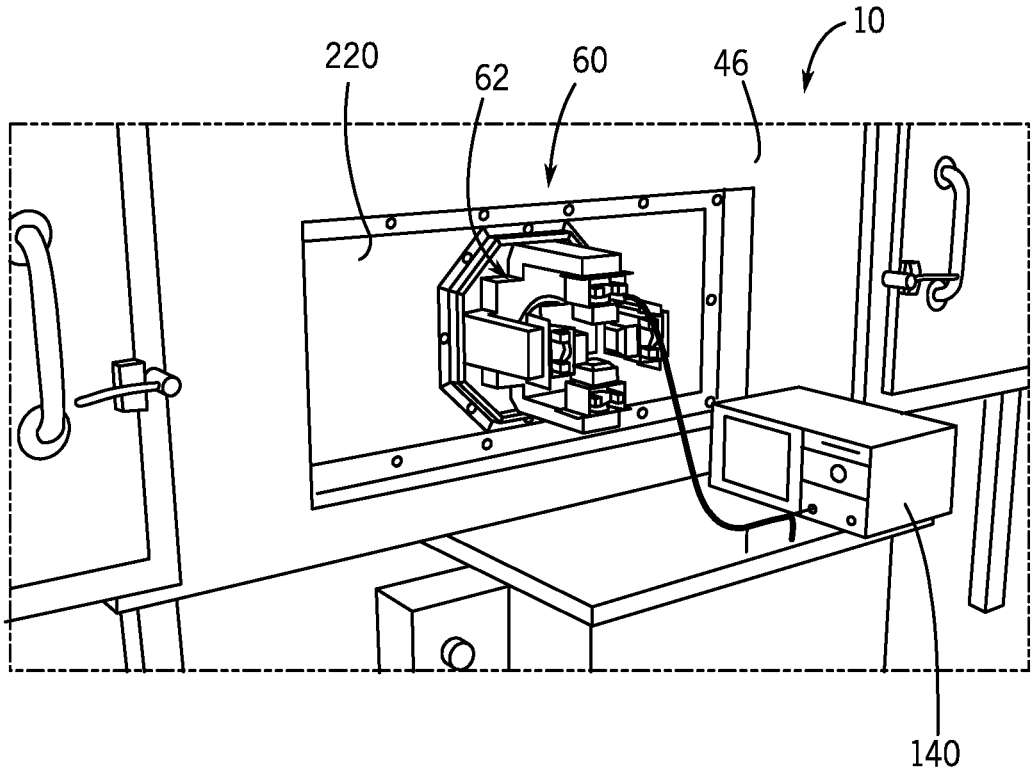
FIG. 16 is a launch box assembly coupled to the oven.

Referring to FIG. 15, in order to optimize the launch box assembly 62, the distance between the match plate 114 and the launch box cavity 82 is calibrated to such that the launch box assembly 62 operates into free-space impedance of 377.0 ohms. In order to calibrate each launch box assembly 62, it is disconnected from the oven 10 and positioned such that the match plate 114 extends upwardly into the atmosphere, e.g. free space (see FIG. 15). A network analyzer 140 is attached to the launch box assembly 62 and the magnetrons 120 are turned on. The legs 116 of the match plate 114 include adjustable fasteners that allow the distance between the match plate 114 and the launch box cavity 82 to be adjusted such that the expected SWR is achieved and the impedance measured by the network analyzer is free-space impedance (e.g. 377 ohms). The launch box assembly 62 is then coupled to the drive sidewall 46 (FIG. 16) and the distance between the match plate 114 and the launch box cavity 82 is again adjusted to match or replicate the free-space impedance determined during calibration. As such, the impedance in the microwave launch box section 18 and the microwave chamber 31 is reasonably set to or understood to be equal to, the free-space impedance and accordingly, the impendence within the microwave chamber 31 remains unaffected by varying loads of food products conveying through the microwave chamber 31.

Referring back to FIG. 6, the present inventors have also determined that the position of the launch box assemblies 62 relative to the belt 50 is important for efficient and effective operation of the oven 10. In particular, the belt 50 is positioned at least one-quarter wavelength (λ/4) from the drive sidewall 46 (see distance BO on FIG. 6). That is, the belt 50 is positioned more than 28 millimeters from the drive sidewall 46 (note that the microwave energy propagating in the launch box 80 have a wavelength (λ) of 112 millimeters, as discussed above). As such, the present inventors have observed that the E-field and the H-field components of the microwaves prorogate differently in the microwave chamber 31. Specifically, the E-field or voltage propagates around the perimeter of the match plate 114 while the H-field or current down the drive sidewall 46 and jumps to the belt 50. That is, the H-field or current component of the microwave propagates along the drive sidewall 46 and does not touch the match plate 114 (e.g. the voltage along the drive sidewall 46 and the belt 50 is zero) while the E-field or voltage is in the perimeter 115 of the match plate 114. As there is a maxima of H-field or current and zero E-field or voltage along the drive sidewall 146, the H-field or current jumps or flows to and across the belt 50 thereby cooking the food product as it is conveyed through the microwave launch box section 18. As such, the intensity or application of the E-field to process the food product is lower when compared to the E-fields used to process foods in conventional ovens that have microwave energy generating devices, and the intensity or application of the H-field to process the food product is higher when compared to H-fields used to process foods in conventional ovens that have microwave energy generating devices. Further, the H-field component of the microwave energy emitted primarily cooks the food product.

Referring back to FIGS. 2 and 11, the distance between multiple (two) launch box assemblies 62 on the same sidewall 46, 47 of the oven 10 is an important factor to maximize the microwave energy in the chamber 30. In particular, the present inventors have observed that the launch box assemblies 62 on the same sidewall 46, 47 are subjected to cross-coupling between the match plates 114 that effectively reduces the energy propagating from the launch box assemblies 62 by 10.0-15.0%. In order to minimize the energy lost, the match plates 114 of the launch box assemblies 62 are placed five-wavelengths (5λ) apart from each other. That is, the present inventors have determined that the distance between launch box assemblies 62 (the centers thereof) on the same sidewall 46, 47 should be greater than or equal to five-wavelengths (e.g. 5×120 mm=600 mm; see first longitudinal distance S1 on FIG. 11). As such, the properly spaced launch box assemblies 62 on one of the sidewalls 46, 47 achieves maximum microwave transmission with minimal coupling between the launch box assemblies 62 (e.g. "cross-talk" is prevented).

Figure 5:
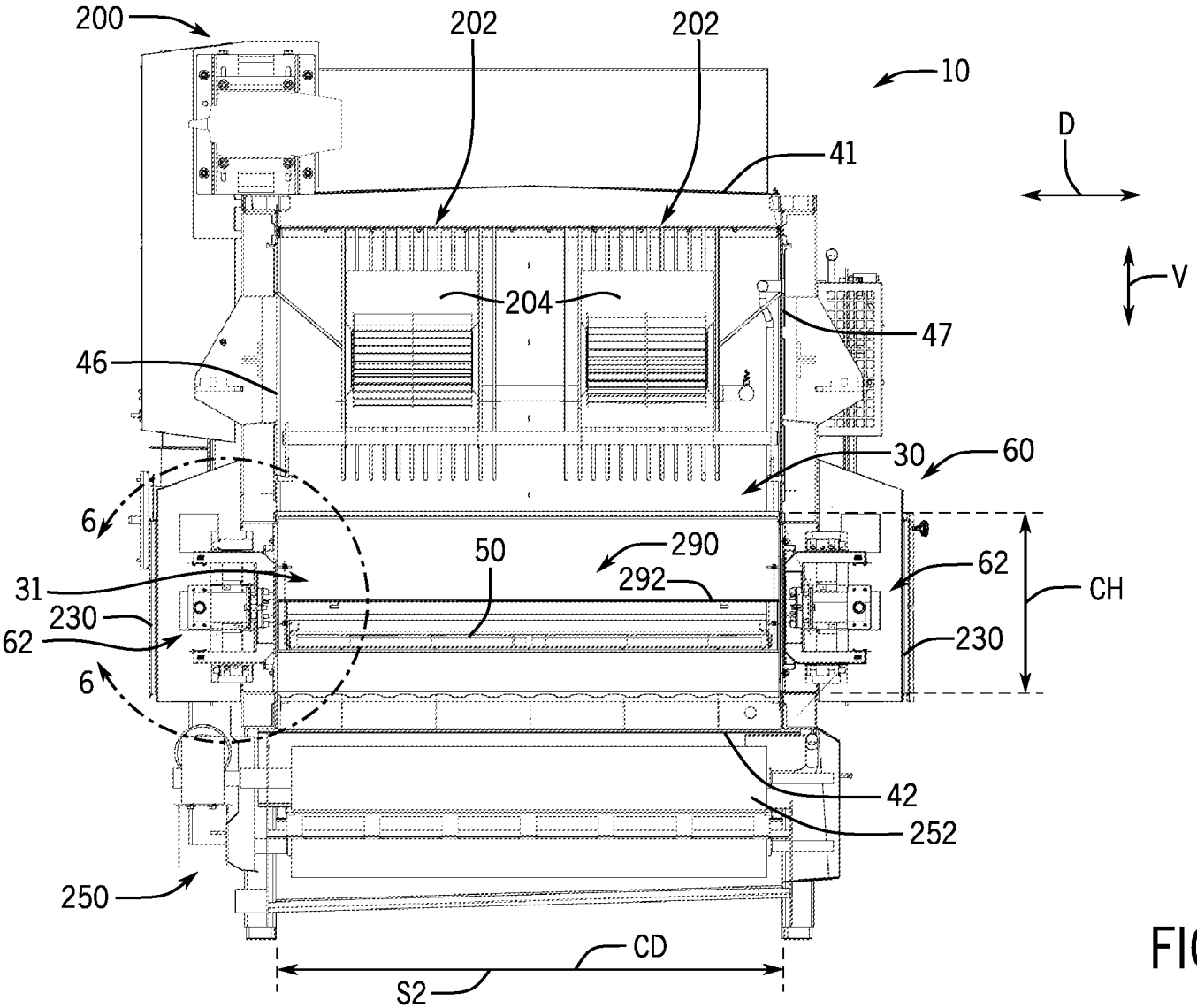
FIG. 5 is a cross-sectional view of the example oven of FIG. 1 along line 5-5 on FIG. 1.
Figure 6:
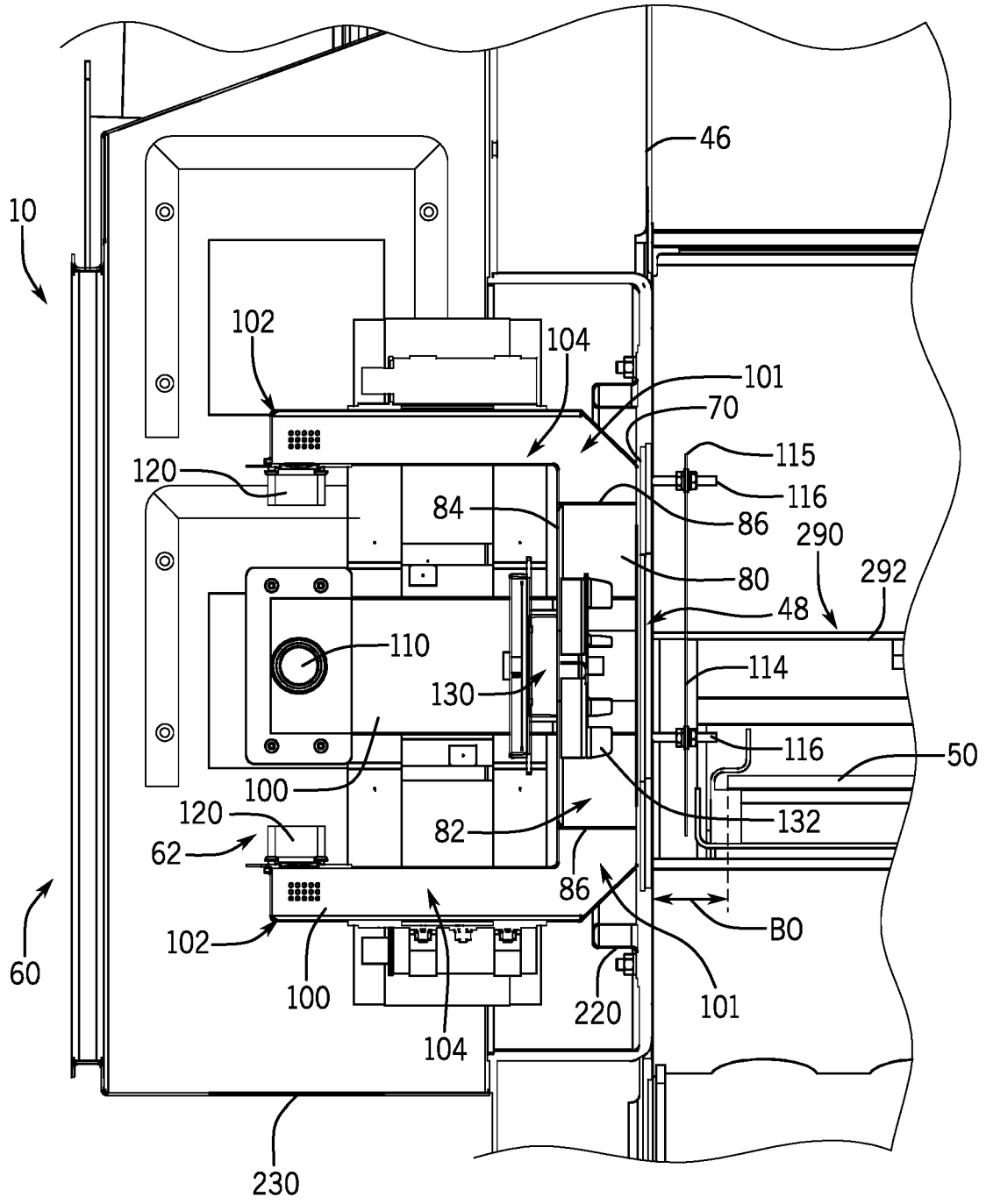
FIG. 6 is an enlarged view of a launch box assembly within line 6-6 on FIG. 5.
Figure 17:
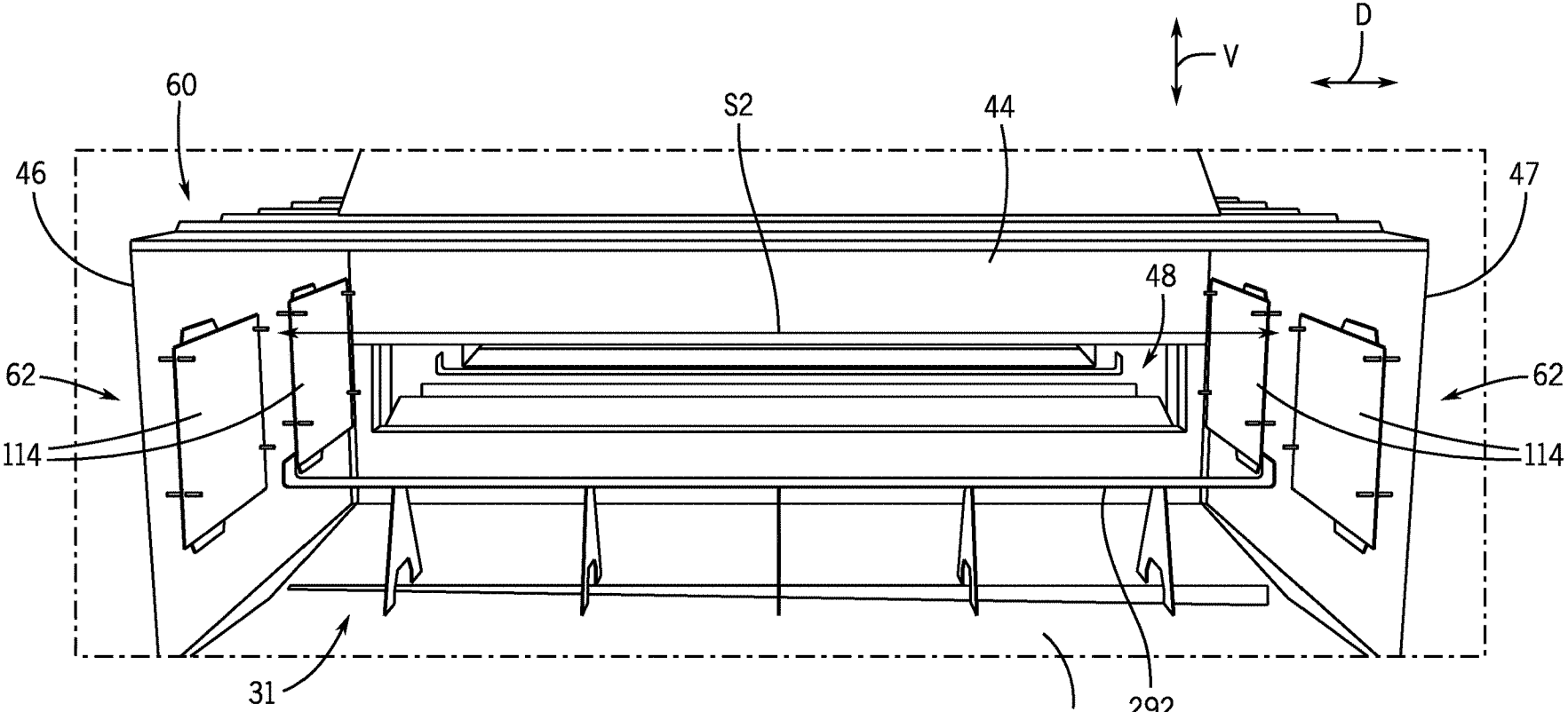
FIG. 17 is a perspective view within the oven depicting launch box assemblies on the drive sidewall and the idle sidewall.
Figure 18:
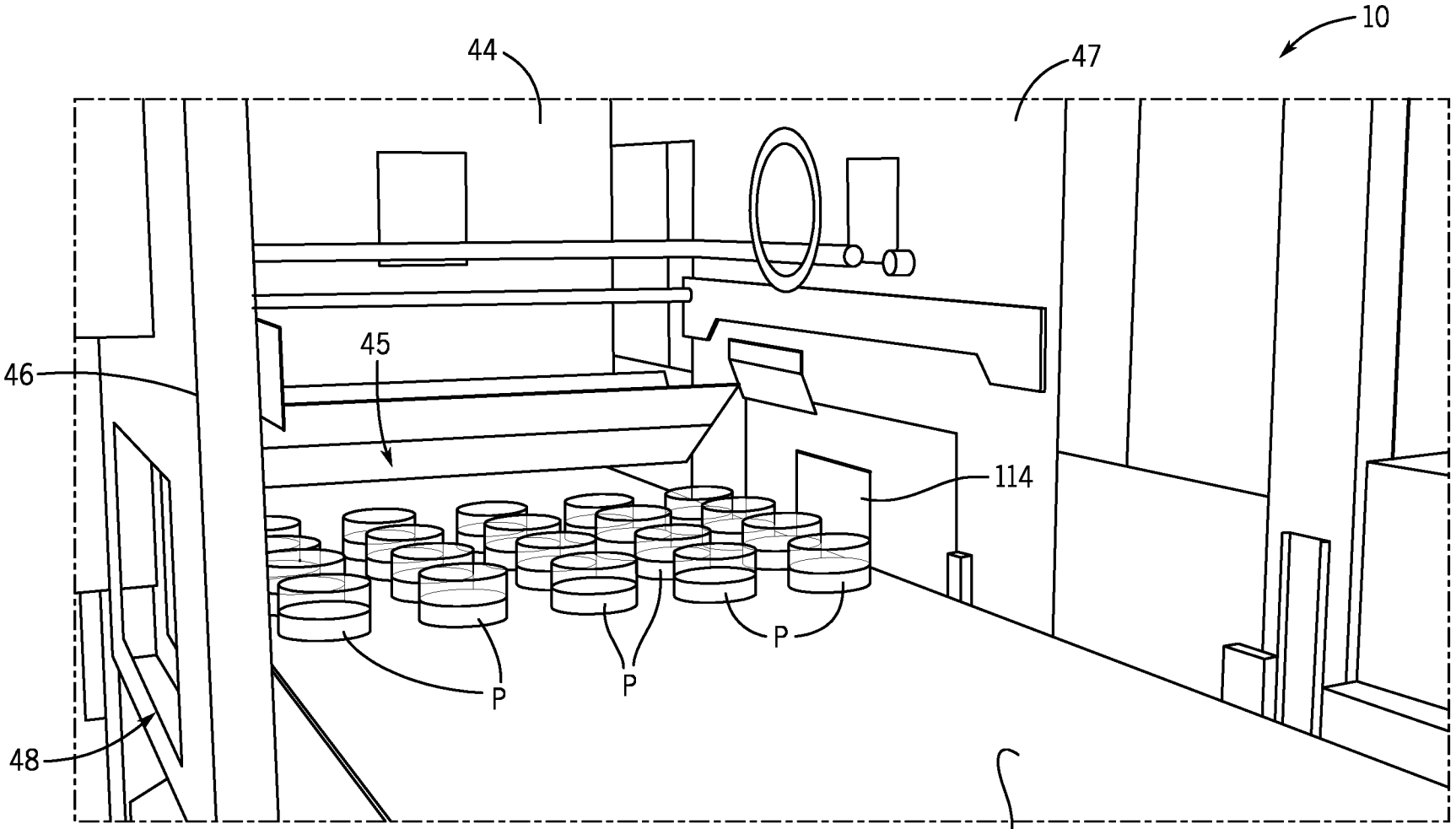
FIG. 18 depicts food products on a belt in a microwave chamber of the oven.

Referring to FIGS. 5 and 17, the distance between launch box assemblies 62 on the drive sidewall 46 and launch box assemblies 62 the idle sidewall 47 is also important to maximize the microwave energy propagating in the microwave chamber 31. That is, the present inventors have determined that the launch box assemblies 62 should be placed a minimum of five wavelengths (5λ) apart (see first lateral distance S2 on FIG. 5, note that the first lateral distance S2 is equal to the microwave cavity depth CD). The first lateral distance S2 between the opposing launch box assemblies 62 will prevent the magnetrons 120 from heating each other up, minimize cross-coupling effects, and create coupling between the match plates 114 on opposing sidewalls 46, 47 that effectively overcomes the loss in energy observed between the launch box assemblies 62 positioned on the same sidewall 46, 47 (e.g. the 10-15% energy lost due to the launch box assemblies 62 placed on the drive sidewall 46 is gained by coupling effects between the launch box assemblies 62 on the opposing, idle sidewall 47). FIG. 18 depicts food products P on the belt 50 in microwave chamber 31. Furthermore, the present inventors have also recognized that in order to optimize each launch box assembly 62 on opposing sidewalls 46, 47 to thereby achieve maximum microwave transmission and minimal coupling between other launch box assemblies 62 (i.e. prevent "cross-talk"), the distance between each launch box assembly 62 on opposing sidewalls 46, 47 is an odd multiple (i.e. 3, 5, 7) of 'free space' wavelength.

Figure 19:
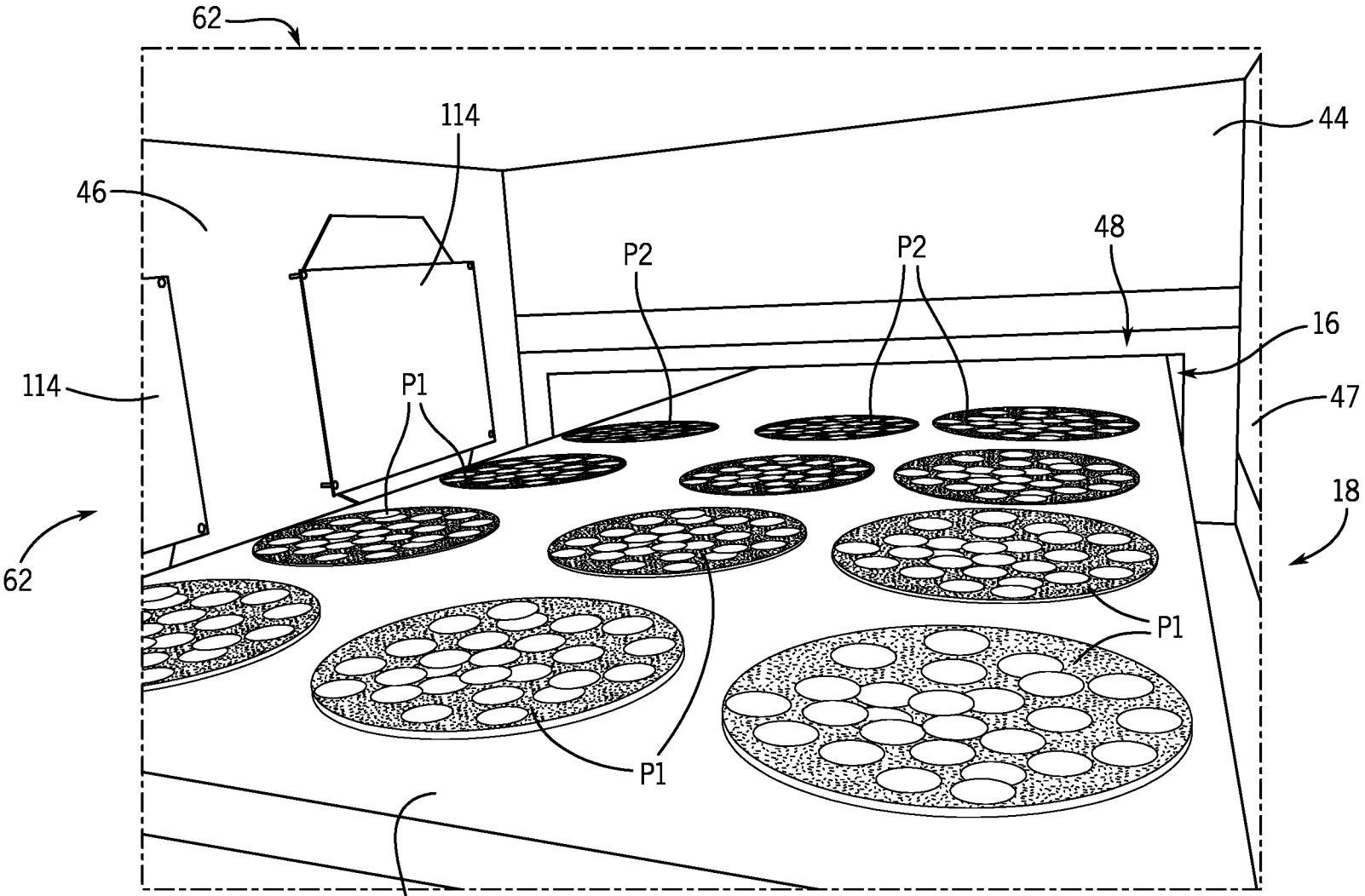
FIG. 19 depicts example food products, e.g. pizzas, on the belt in the microwave chamber of the oven.

Accordingly, the operation of the microwave launch box system 60 described above causes the food product conveyed by the belt 50 through the microwave chamber 31 to be processed (e.g. cooked, charred, grilled) by the H-field component of the microwave energy that propagates along the belt 50. In a simple experiment (see FIG. 19) frozen pizzas were loaded onto the belt 50 such that some pizzas P1 were positioned completely within the microwave launch box section 18 and some pizzas P2 positioned halfway within the microwave launch box section 18 and the convection sections 16. The present inventors observed that when the microwave launch box system 60 was activated the H-field component of the microwave energy propagates into the belt 50 and heats the pizzas by conduction causing the ingredients of the pizzas to warm and at least partially cook. As such, pizzas P1 fully within the microwave chamber 31 were fully exposed to the conduction heating while the pizzas P2 only halfway within microwave chamber 31 were only halfway exposed to the conduction heating. That is, the first halves of the pizzas P2 within the microwave chamber 31 were cooked/heated while the second halves of the pizzas P2 outside the microwave chamber 31 (e.g. in the convection section 16) were not-cooked/unheated. The H-field component of the microwave energy remains into the microwave launch box section 18 and the microwave chamber 31 and only cooks/heats food products therein.

In addition to the processing (e.g. cooking, heating) of the food products within the microwave chamber 31 with the microwave launch box system 60, the food products are processed by the convection heating system 200 in the chamber 30 (including the microwave chamber 31). Referring back to FIG. 5, the convection heating system 200 includes a first heating element 202 positioned in the chamber 30 at the second convection section 20 and in some examples, a second heating element (not shown) is positioned in the chamber 30 at the first convection section 16. The heating element 202 is configured to heat the air within the chamber 30 to thereby process (i.e. heat, cook) the food products that are conveyed by the belt 50 through the chamber 30. A fan 204 is positioned in the chamber 30 and is configured to force the warmed or convected air onto the food product to thereby process the food products. The fan 204 is orientated in the chamber 30 such that the air conveyed by the fan 204 in a circuitous path or looped air flow (e.g. vertically downwardly from the fan 204, through the belt 50, radially outwardly toward the endwalls 43, 44, and vertically upwardly toward the fan 204, see also flow arrows on FIG. 4). Reference is made to above-incorporated U.S. Pat. No. 6,604,452 for further description of the looped air flow and components of the oven. The heating element 202 can be any suitable heating element such as burners, radiant electric coils, thermal oil coils, and/or the like.

Figure 2:
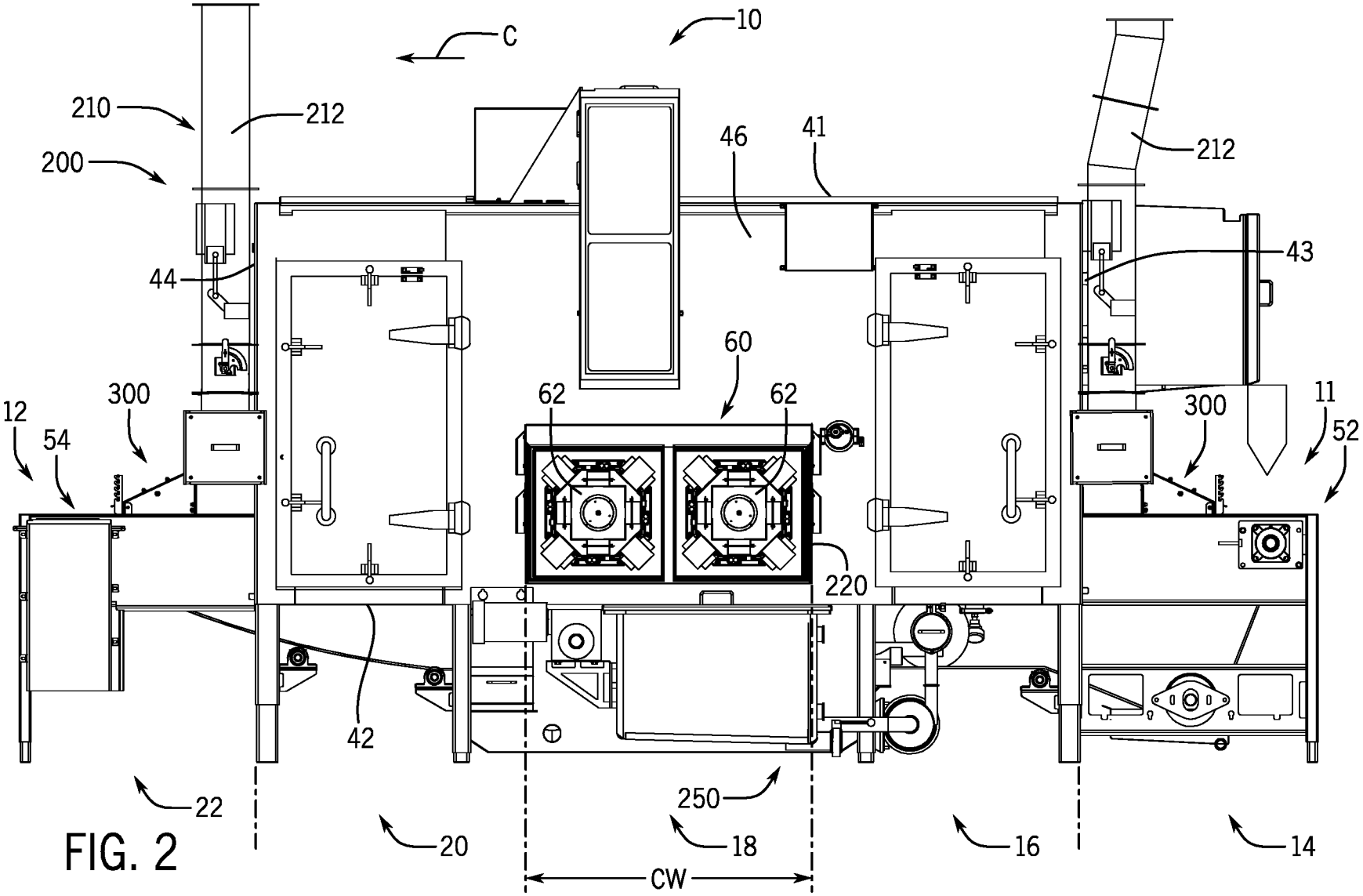
FIG. 2 is a drive side view of the oven of FIG. 1.
Figure 3:
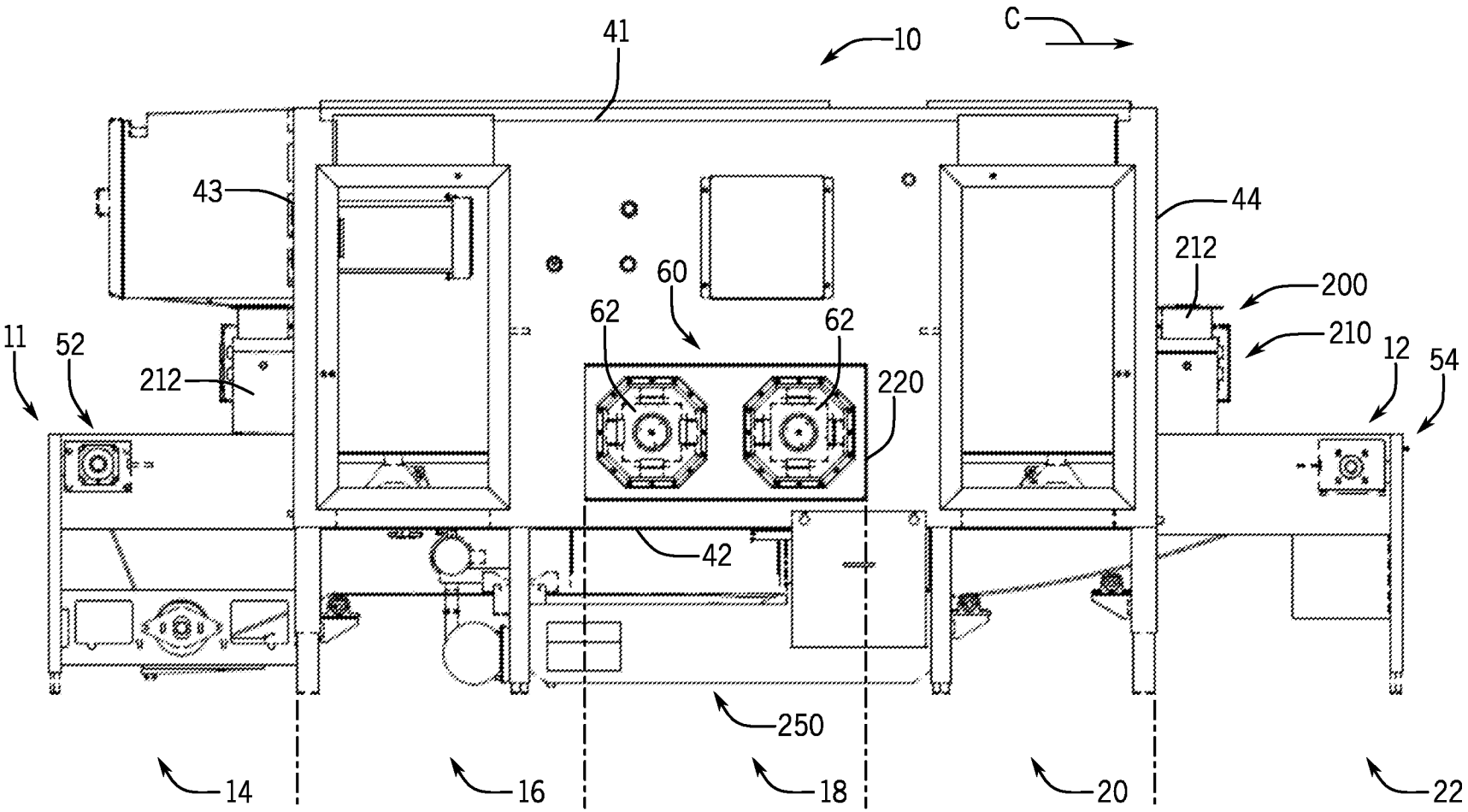
FIG. 3 is an idle side view of the oven of FIG. 1.

Referring to FIG. 2, the convection heating system 200 includes an air exhaust system 210 that is configured to exhaust air from the chamber 30 (FIG. 4) according to the preselected processing requirements set by the operator for each food product conveyed through the chamber 30. That is, the air exhaust system 210 is configured to maintain optimum temperature (wet bulb temperature and dry bulb temperature) and humidity for the food products being conveyed through the chamber 30. The air exhaust system 210 has exhaust ducts 212 positioned at the openings 45 defined in the endwalls 43, 44. The air exhaust system 210 can also include steam injection systems (not shown) that are configured to inject steam into the chamber 30. A person having ordinary skill in the art will recognize that any suitable air circulation component or device (e.g. ducts, sensors, flavor injectors) may be included with the air exhaust system 210 to thereby process the food product conveyed through the chamber 30. Reference is made to above-incorporated U.S. Pat. No. 6,604,452 for further description of example air exhaust systems.

Figure 20:
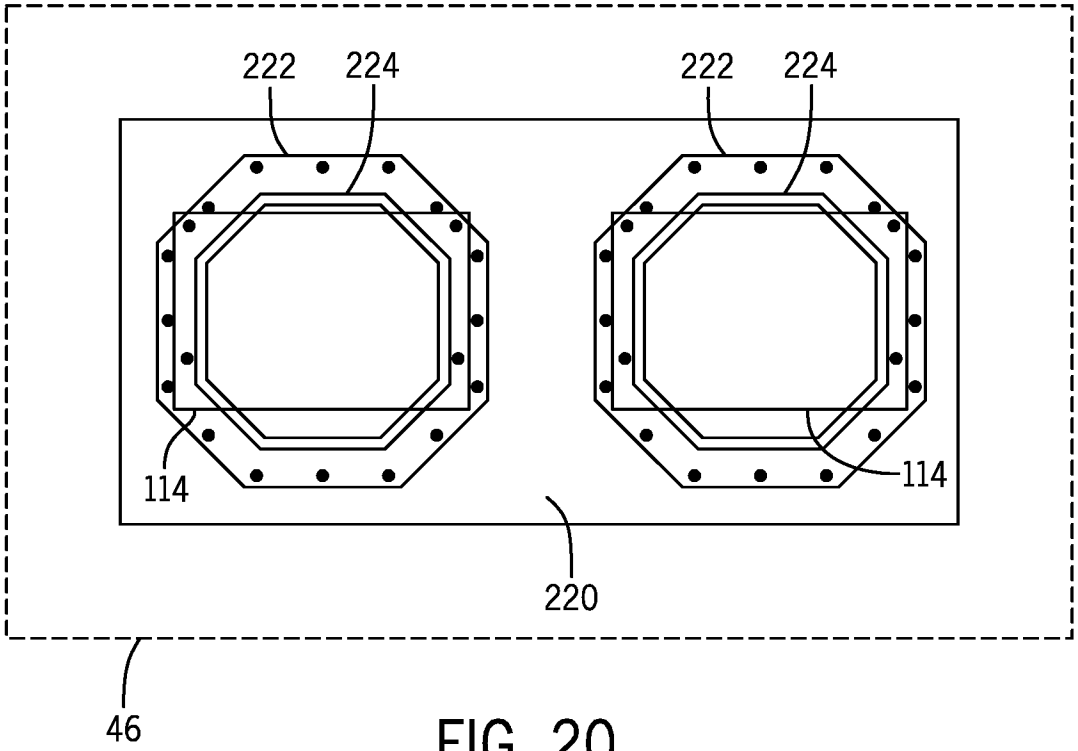
FIG. 20 is a front view of an example support frame.
Figure 21:
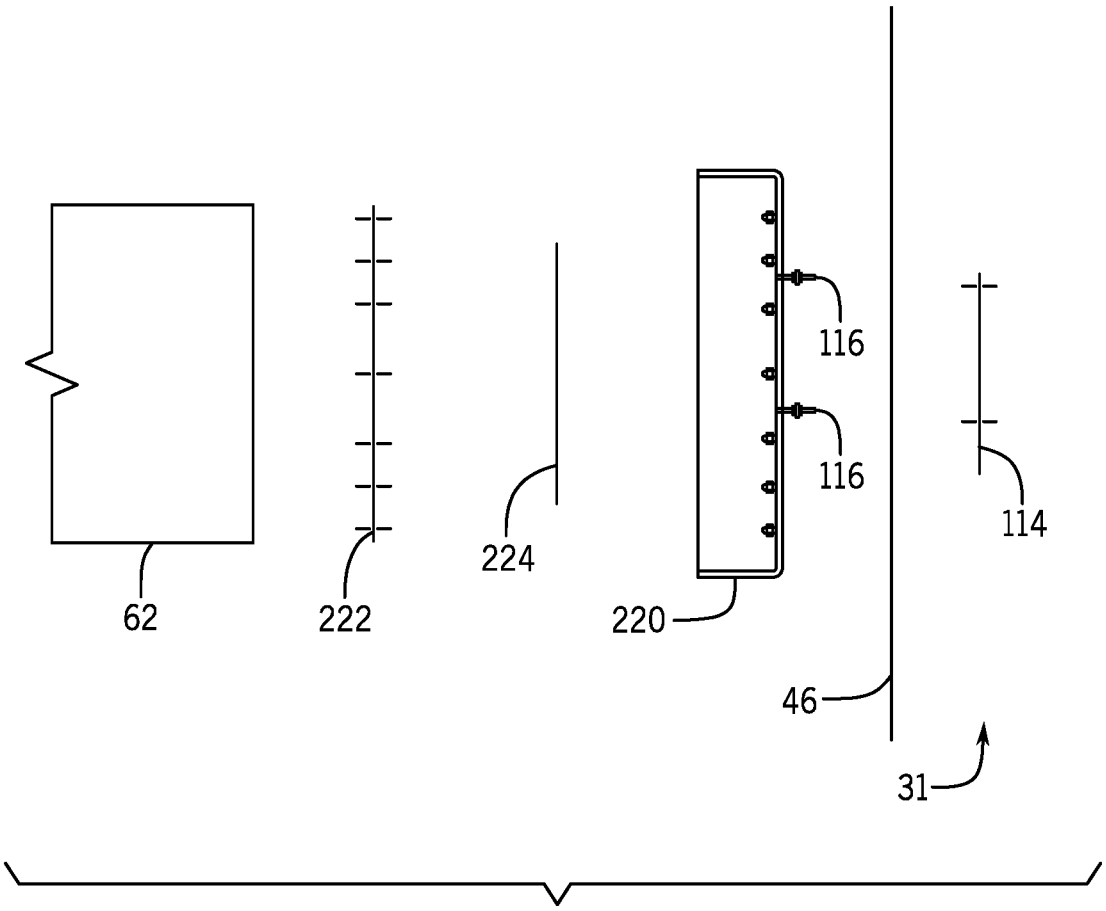
FIG. 21 is a exploded view of the drive sidewall with the support frame.

Referring to FIGS. 20-21, the oven 10 includes a support frame 220 that is coupled to a sidewall 46, 47 to support the microwave launch box system 60 and/or the launch box assemblies 62 on the sidewall 46, 47. FIG. 21 depicts an exploded side view of the support frame 220 and the sidewall 46. When the support frame 220 is coupled to the sidewall 46, a mica gasket 222, and a silicone gasket 224 is coupled or sandwiched between the support frame 220 and the launch box assembly 62. Note that FIG. 21 depicts the legs 116 of the match plate 114 integral with the support frame 220.

Figure 22:
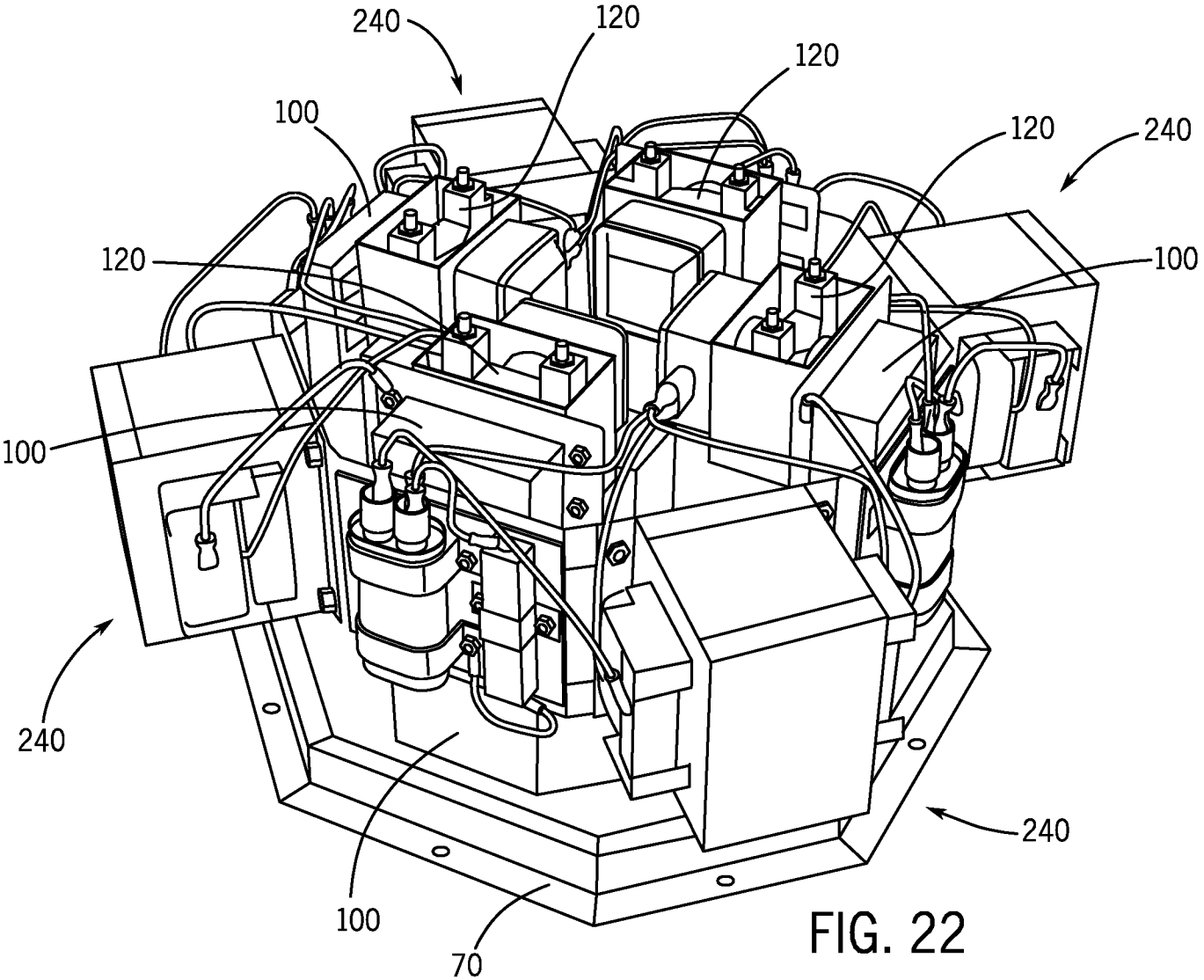
FIG. 22 is an example launch box assembly with magnetrons and magnetron cooling systems.

Referring back to FIG. 1, the oven 10 includes microwave enclosures 230 covers and protects the microwave launch box system 60 and/or the launch box assemblies 62 from damage and/or environmental conditions (e.g. dust, moisture). The microwave enclosures 230 also protect magnetron cooling systems 240 (see FIG. 22) that are coupled to the magnetrons 120 and configured to cool the magnetrons 120 during operation. The magnetron cooling systems 240 can include any suitable refrigeration or cooling system such as water-cooled jackets, water/glycol based systems, fans, heat exchangers, and/or the like.

Figure 23:
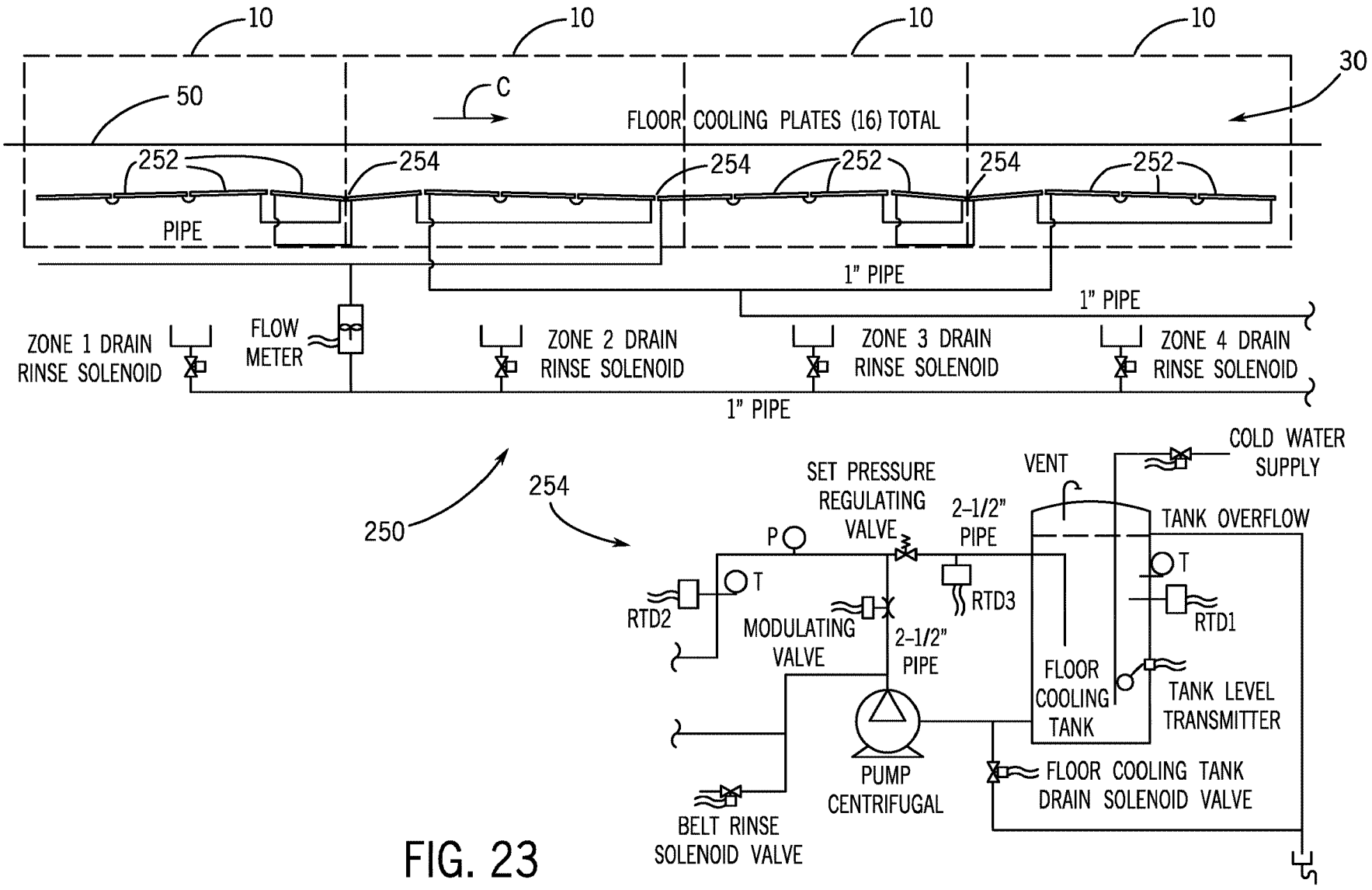
FIG. 23 is a schematic plumbing diagram of an example water-cooled floor system plumbing schematic diagram.
Figure 24:
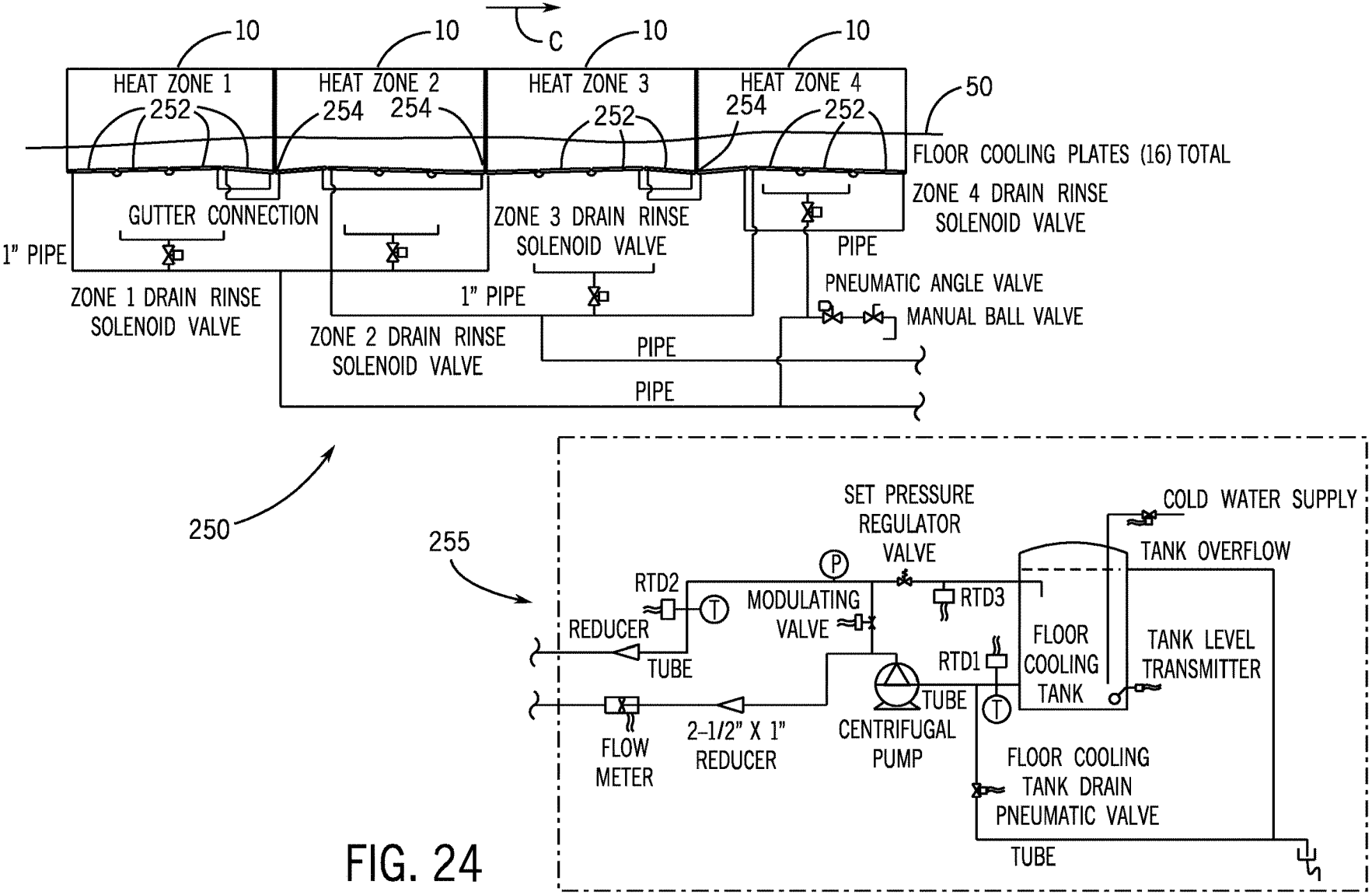
FIG. 24 is a schematic plumbing diagram of another example water-cooled floor system.

Referring to FIGS. 1, 4, and 23-24, the oven 10 can include a water-cooled floor system 250 positioned in the chamber 30 and vertically below the belt 50 to collect the cool grease and/or other liquids that may fall from the food product while the food products are conveyed and processed in the chamber 30 (note FIGS. 23-24 depict a water-cooled floor system 250 for four ovens 10 positioned adjacent to each other). The water-cooled floor system 250 includes sloped floor panels 252 that are sloped toward drains 254 that lead to a grease removal system 255 and water sprayers (not shown) that are configured to spray water onto the belt 50 and/or the sloped floor panels 252. The grease removal system 255 can include a number of pipes that permit the grease to be transported away from the oven 10, and the grease removal system 255 can include valves, tanks, pipes, and/or pumps that are configured to transport the grease away from the oven 10. The grease removal system 255 can be mounted or integral to the oven or independent from the oven (e.g. the grease removal system 255 could be constructed into the concrete floor of the building in which the oven 10 is housed). The water-cooled floor system 250 can also be configured to cool and/or clean the belt 50 to thereby remove any residual components from the belt 50 that may be left by the food products.

A person having ordinary skill in the art will recognize that any number of water-cooled floor system 250 can be utilized with any number of oven 10 (e.g. one water-cooled floor system 250 with one oven 10, two water-cooled floor systems 250 with two ovens 10). In certain examples, a circulation pump is configured to circulate water through the system at a pressure that as can be manually set by a pressure regulating valve. A flow meter can be included to sense or detect the pressure of the water to confirm that panels of the water-cooled floor system 250 are receiving cooled water. The pumped water flow is a VFD controlled by a controller 400 (described hereinbelow with reference to FIG. 33) and based on feedback from a resistance temperature detector (e.g. RTD2) to control flow of cooling water through the sloped floor panels 252 and limit return water temperature from the sloped floor panels 252. A modulating valve is included to bypass the water-cooled floor system 250 and to mix temperature controlled water with the return water from the sloped floor panels 252. The modulating valve is controlled by the controller 400 based on feedback from a resistance temperature detector (e.g. RTD3) to limit the mixed water temperature from the sloped floor panels 252 and bypass water line. In certain examples, intermittently and in reverse process sequence hot water is sprayed into drain troughs of each oven or zone to carry excess grease from the oven 10 to the drains. Cold water can be added, from a tank, to maintain floor cooling system temperature based on feedback from a resistance temperature detector (e.g. RTD1) such that the controller 400 controls an inlet solenoid valve to add cold water to maintain the water temperature+/−5.0 degrees Fahrenheit. Excess water in the tank overflows to a belt wash section or any other area of the oven 10 that requires hot water.

Referring to FIGS. 25-31, the oven 10 is equipped with microwave instrumentation to monitor the microwave energy in the oven 10 and prevent microwave energy from leaking out from the oven 10. Regulations related to the amount of microwave energy from an oven are set forth by various jurisdictions to prevent unhealthy human exposure to microwave energy within biological limits. For example, in the United States, common standards dictate the total microwave energy leakages from microwave generated equipment, e.g. the Emission Standard, must be less than 5.0 milliwatts per square centimeter and the biological standard is 10.0 milliwatts per square centimeter. Accordingly, the present inventors have developed a system monitoring equipment to detect the amount of microwaves leaked from the oven 10. For example, microwave energy monitoring detectors can be commonly known types with spiral configuration to support both E and H fields. In these examples, each leg of the antenna with spiral configuration is fed into a commonly known Wheatstone Bridge circuit with coupling to microwave detection diodes and amplifier circuitry.

Figure 25:
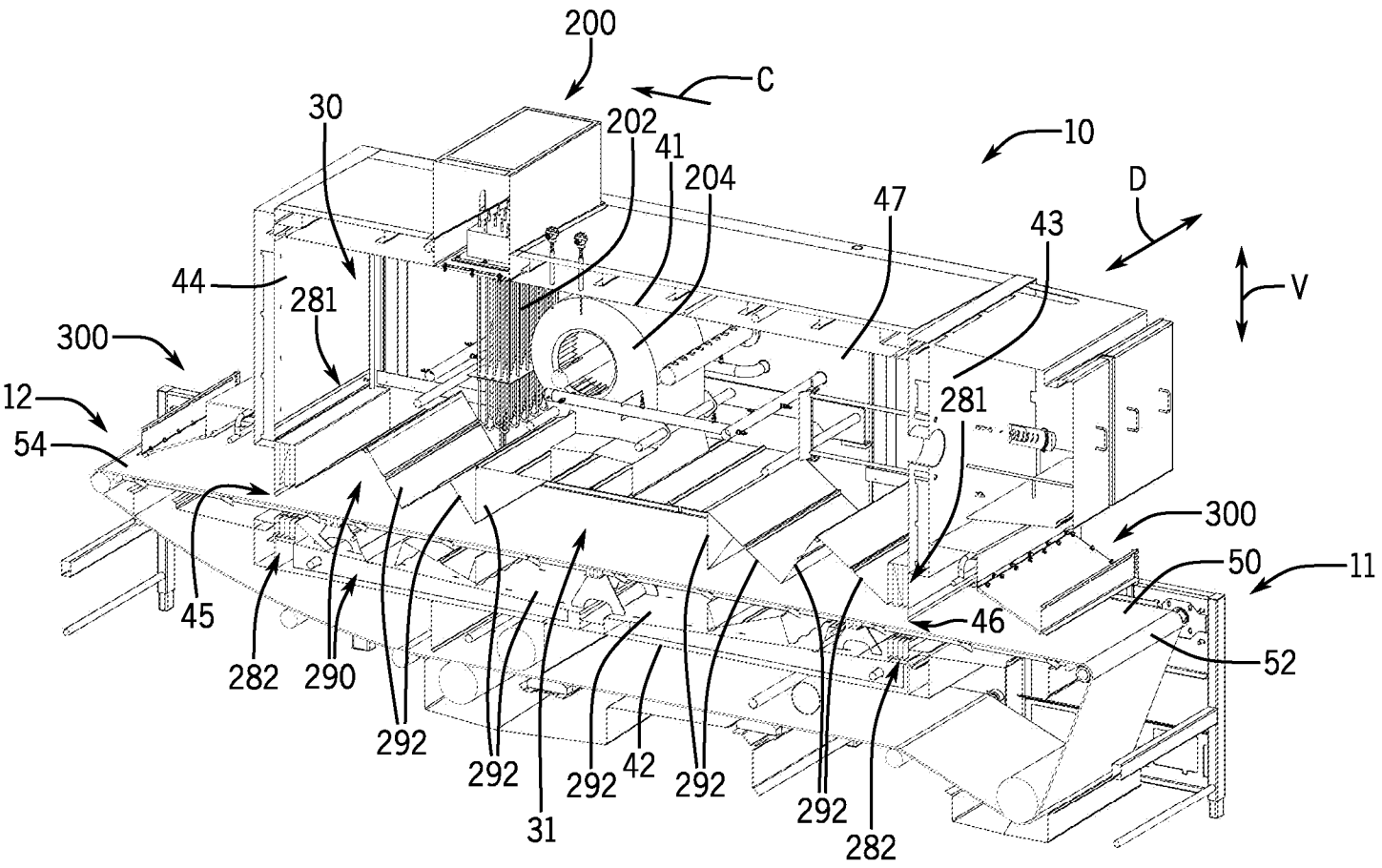
FIG. 25 is a perspective view of the oven with the drive sidewall removed to expose internal components.
Figure 26:
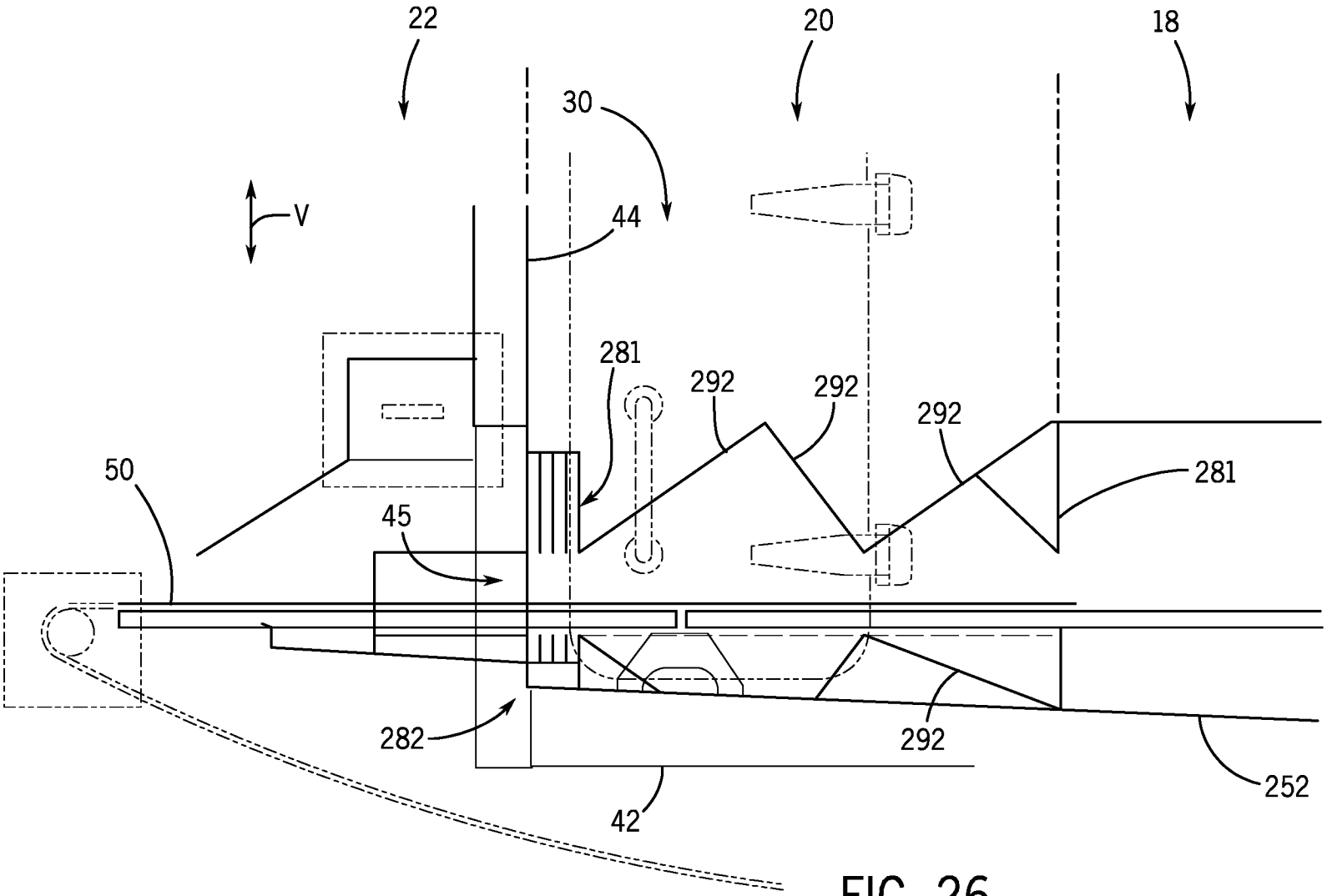
FIGS. 26-29 are enlarged views of example microwave leakage prevention components in the oven.
Figure 27:
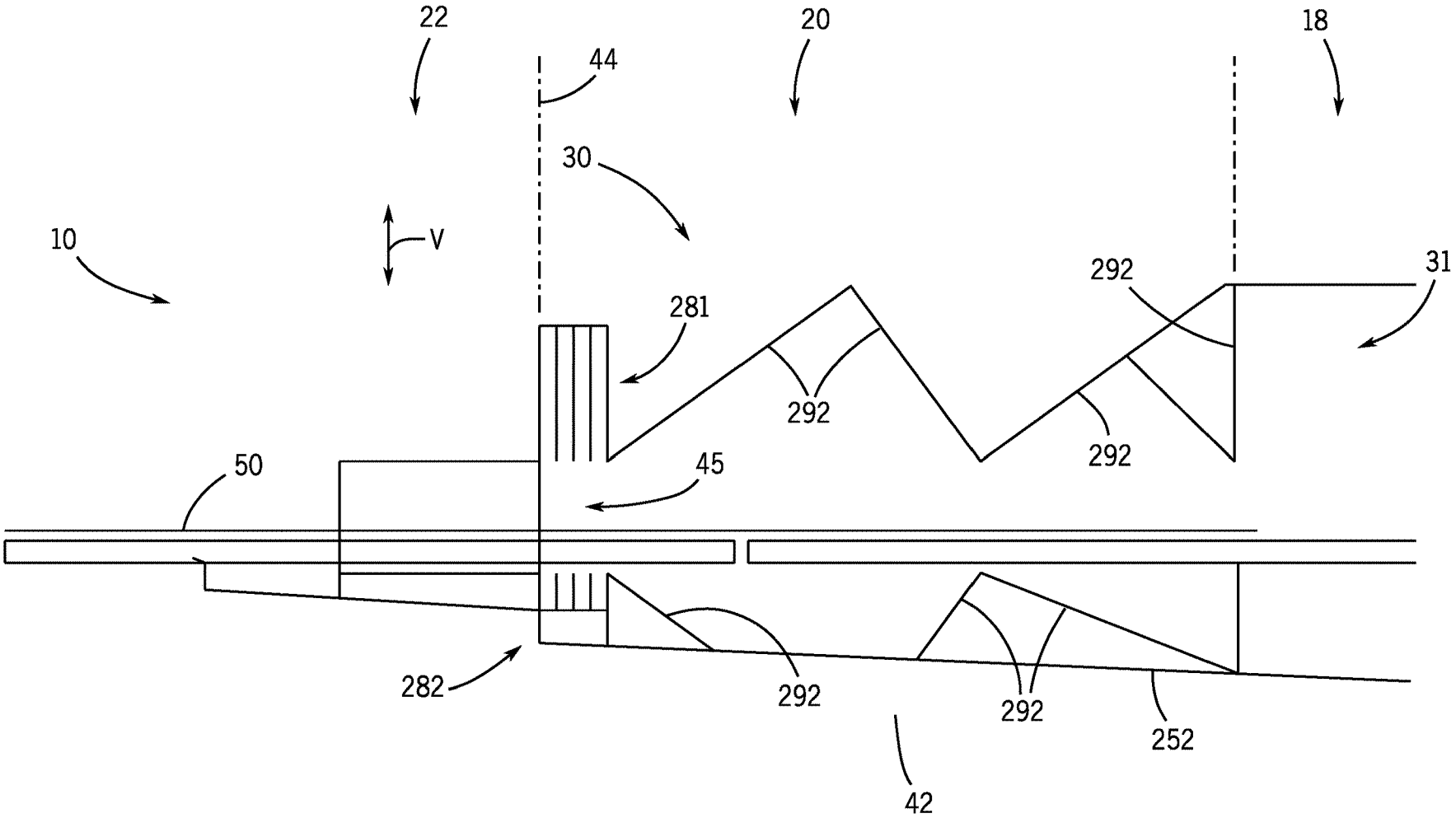
Figure 28:
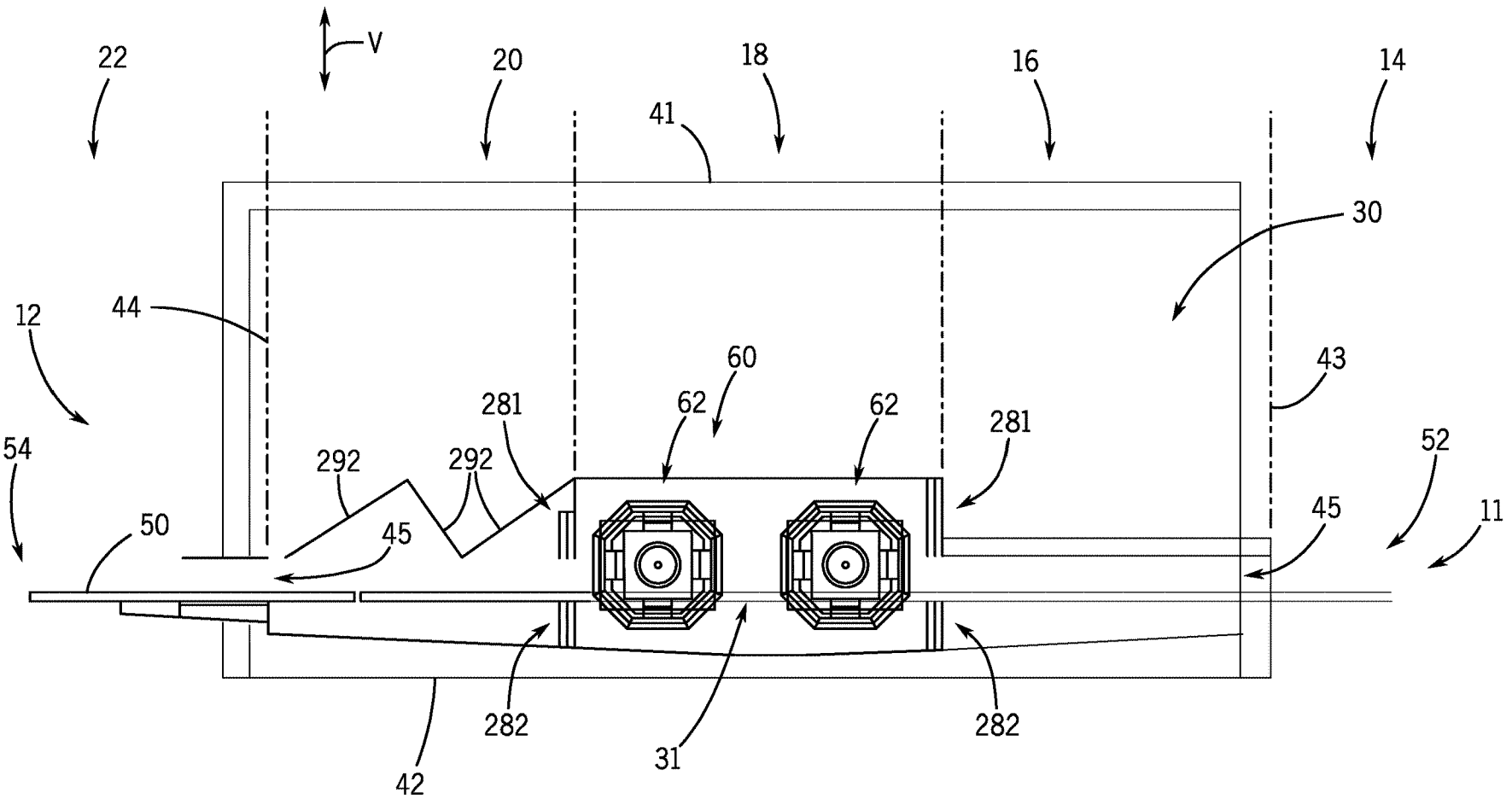

FIG. 25 depicts a perspective cross-sectional view of an example oven 10 (as described above) with upper chokes assemblies 281, lower choke assemblies 282, a perforated screen system 290, and hoods 300. The choke assemblies 281, 282 are at the entrance and exit of the chamber 30, and in some example the choke assemblies 281, 282 are positioned inside chamber 30. The choke assemblies 281, 282 are configured to trap microwave energy and have a dimension (e.g. longitudinal width) of a one-quarter wavelength ($\lambda/4$) 31 mm FIGS. 26-27 depict choke assemblies 281, 282 at the opening 45 of the downstream endwall 44. FIG. 28 depicts choke assemblies 281, 282 positioned in the chamber 30 on either side of the microwave launch box section 18. A person having ordinary skill in the art will recognize that the choke assemblies 281, 282 can be positioned downstream side of the microwave launch box section 18 to thereby prevent microwaves from leaking for the opening 45 in the upstream endwall 43.

Figure 29:
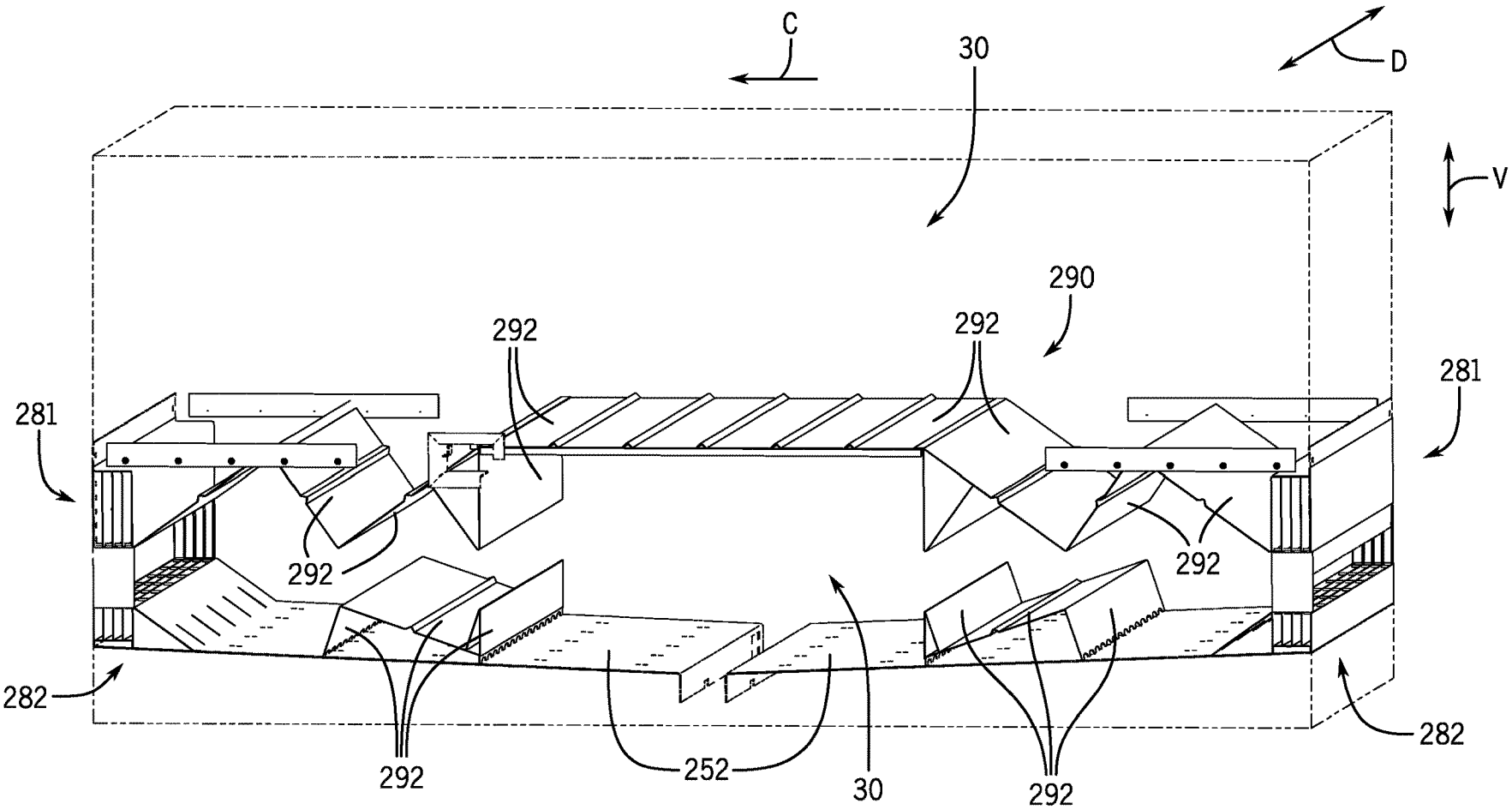

Referring to FIGS. 25 and 29, the oven 10 includes a perforated panel assembly 290 configured to absorb, contain, and/or prevent leakage of microwaves from the oven 10. The perforated panel assembly 290 includes a plurality of a panel 292 that are welded to each to each other at various angles to absorb the microwaves and/or deflect microwaves toward the center of the oven 10. The panels 292 can also sit or connect to the sloped floor panels 252. The panels 292 include perforations that allow the heated air conveyed from the fan 204 to circulate through the chamber 30 and/or microwave cavity. The present inventors have also observed that the perforated panels 292 aid in evenly distributing the heated air onto the food products and partially shields the fan 204 from the microwave chamber 31.

Figure 30:
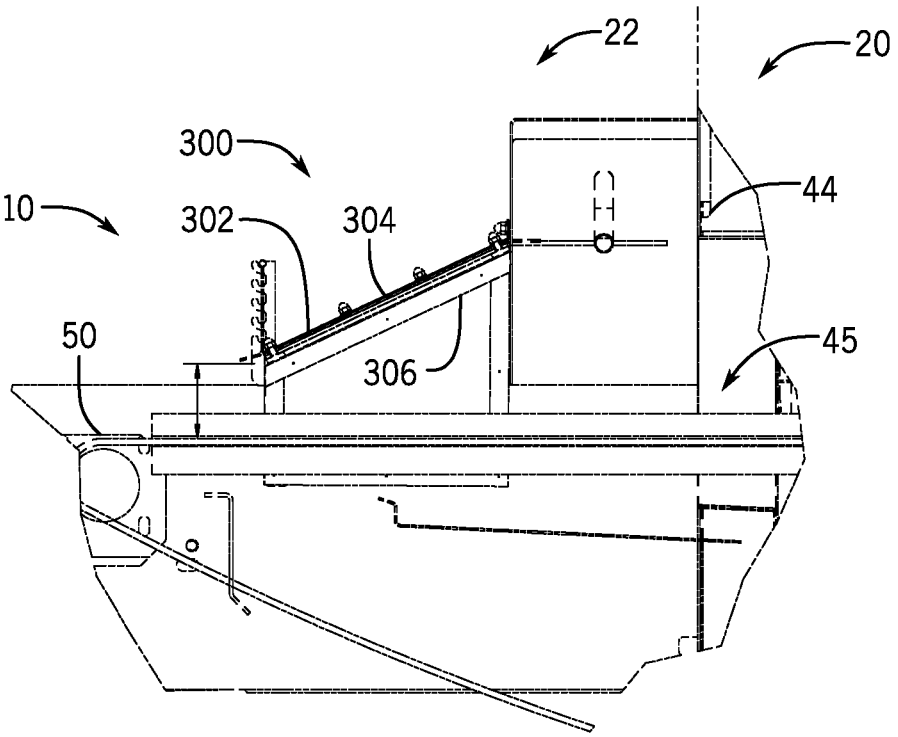
FIG. 30 is an enlarged view of an example hood of the present disclosure.
Figure 31:
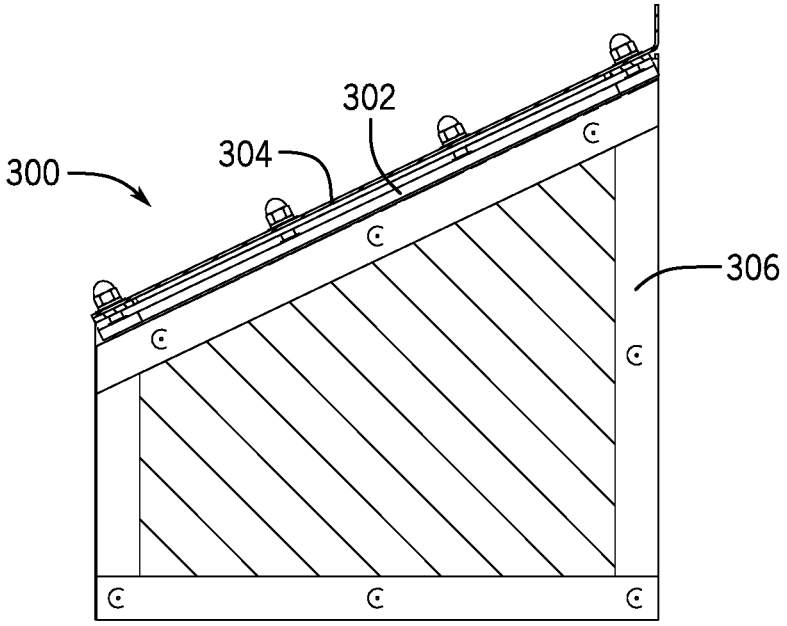
FIG. 31 is an enlarged view of another example hood of the present disclosure.

Referring to FIGS. 25 and 30-31, the oven 10 includes hoods 300 that are positioned at the openings 45 in the endwalls 43, 44 and configured to absorb microwave energy that may leak through the openings 45. The hoods 300 include microwave absorbing tiles 302 enveloped in a gasket 304 (e.g. mica) and are supported on the oven 10 by a frame 306. The orientation of the tiles 302 can vary (e.g. horizontal, sloped). The gasket 304 prevents deterioration of the tiles 302.

Figure 33:
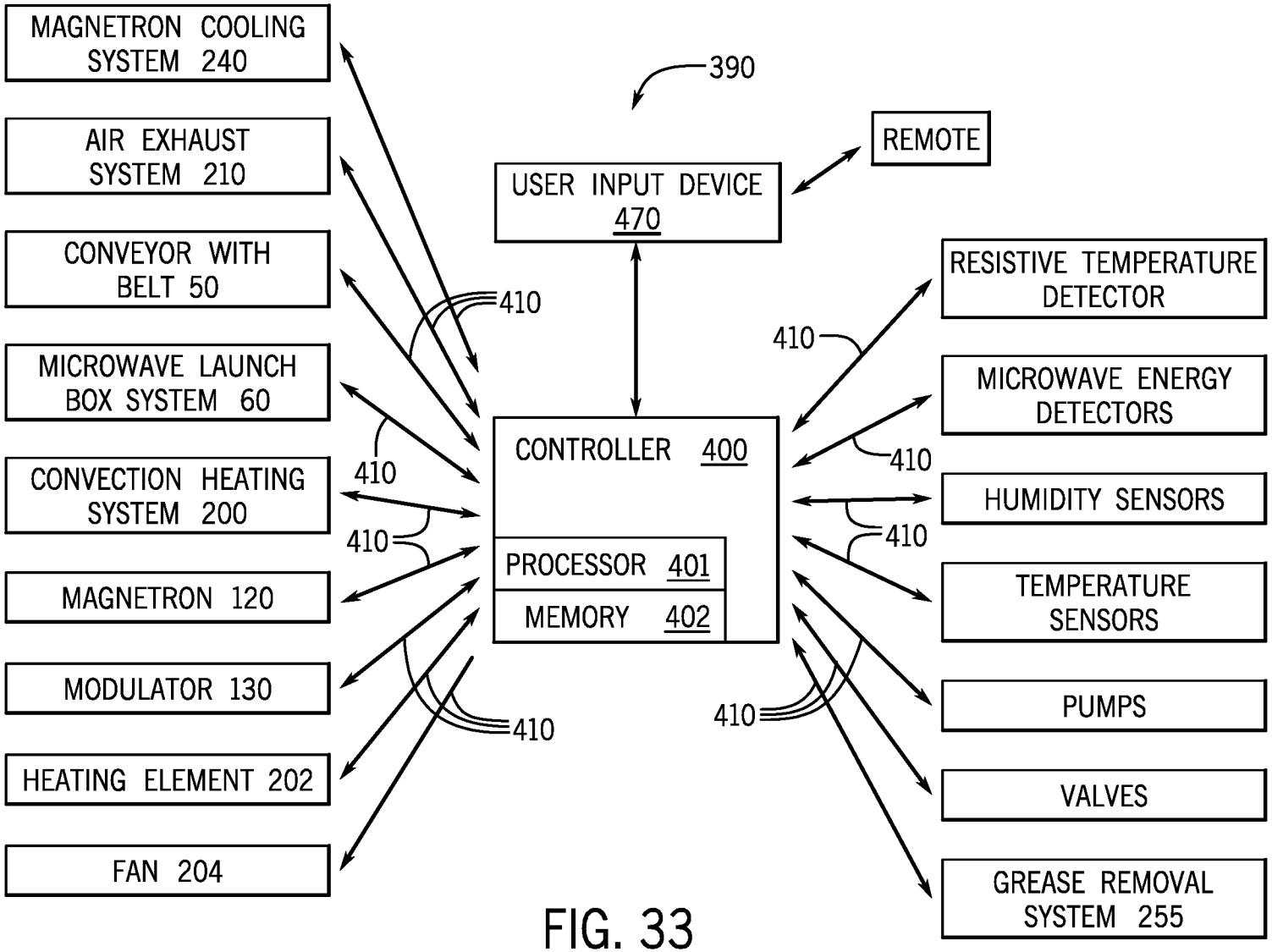
FIG. 33 is a schematic diagram of an example computing system of the present disclosure.

Referring to FIG. 33, The oven 10 can include a computer computing systems 390, including software, are configured to control operation of the oven 10 and components thereof. Specifically, a controller 400 can be included and in communication with components of the oven 10 to control the components based on user input into a user input device 470 related to the food products being processed by the oven 10. For example, the controller 400 can be configured to control and adjust the speed of the conveyor with the belt 50 to convey the food products through the chamber 30. The controller 400 can control the convection heating system 200 based on user inputs, temperature sensors in the chamber 30, and/or humidity sensors in the chamber 30 to thereby maintain the temperature and the humidity in the chamber 30 at desired levels.

FIG. 33 is a schematic diagram of an example computing system 390 with computer controller 400 for the oven 10. Various components are in communication with the computer controller 400 via wired or wireless communication links 410. The computer controller 400 includes a processor 401 and a memory 402. The computer controller 400 can be located anywhere in the computing system 390 and/or located remote from the computing system 390 and can communicate with various components of the oven 10 via a network, peripheral interfaces, and wired and/or wireless communication links 410. Although FIG. 33 shows one computer controller 400, the computing system 390 can include more than one computer controller. Portions of the method disclosed herein below can be carried out by a single computer controller or by several separate computer controllers 400.

In some examples, the computer controller 400 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a cooking method, which directs the processing system to operate and control the convection heating system 200, the microwave launch box system 60, and the conveyor with the belt 50. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "computer controller" or "controller" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A computer controller may include memory (shared, dedicated, or group) that stores code executed by the processing system. The term "code" may include software, firmware, and/or microcode, and may refer to programs, routines, functions, classes, and/or objects. The term "shared" means that some or all code from multiple computer controllers may be executed using a single (shared) processor. In addition, some or all code from multiple computer controllers may be stored by a single (shared) memory. The term "group" means that some or all code from a single computer controller may be executed using a group of processors. In addition, some or all code from a single computer controller may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The computer controller 400 communicates with one or more components of the control system via the I/O interfaces and a communication link, which can be a wired or wireless link. The computer controller 400 is capable of monitoring and controlling one or more operational characteristics of the control system and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link, in fact, provides communication between the computer controller 400 and each of the peripheral devices or components of the oven 10 noted herein, although not every connection is shown in the drawing for purposes of clarity.

The computer controller 400 functionally converts input signals, such as but not limited to order signals, inputs received via a user input device 470, or information from sensors, to output signals, such as but not limited component control signals, according to the computer executable instructions. Each of the input signals can be split into more than one branch, depending on how many functions are to be carried out and/or how many systems or components are to be controlled with each of the input signals. The input signals may be fed to several software modules within the computer controller through branch signals. The exact signals input into the software modules can be taken directly from the corresponding control input device or sensor or could be pre-processed in some way, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal.

The provided description of the computer controller 400 is conceptual and should be interpreted generally, as those skilled in the art will recognize many ways to implement such a computer controller 400. These include implementation using a digital microprocessor that receives input signals or branch signals and performs a calculation using the input signals to produce the corresponding output signals or actuator control signals. Also, analog computers may be used, which comprise circuit elements arranged to produce the desired outputs. Furthermore, look-up tables containing predetermined or calibrated data points may be stored in any fashion to provide the desired output corresponding to a given input signal.

The controller 400 can also control the microwave launch box system 60, the magnetrons 120, the conveyor with the belt 50, and/or the convection heating system 200 based on the amount or number of food products to be conveyed through the microwave chamber 31. The controller 400 is in communication with various detectors and sensors, such as video detectors, microwave energy detectors, humidity sensors, temperature sensors, infrared sensor, etc. and is configured to selectively turn-on and turn-off different components, e.g. certain magnetrons 120, based on the food products sensed. For example, if the load sensors sense a "full" load of food products moving into the oven 10, the controller 400 turns all the magnetrons 120 on so that the food products are heated and cooked by the prescribed microwave energy. In another example, if the load sensors sense a smaller load of food product (i.e. less than a "full load" of food products), the controller 400 turns off certain magnetrons 120 (e.g. only two magnetrons in each launch box assembly 62) so that the smaller load of food products is heated by an appropriate amount of microwave energy and no microwave energy is unnecessarily wasted based on the food product and preprogrammed cooking requirements (e.g. temperature, duration) for the food product. The controller 400 can also control the conveyor with the belt 50 to thereby vary the speed or rate at which the food products are conveyed through the oven 10.

The controller 400 can also be in communication with microwave monitoring detectors 420 positioned on the exterior surfaces of the oven 10 to detect microwave energy leaking from the oven 10. If the microwave monitoring detectors sense more microwaves than a threshold value (e.g. a maximum allowable microwave energy leakage value), the controller 400 shuts off a part or multiple parts of the microwave launch box system 60 and/or the oven 10. The operator can be alerted to the problem by an indicator.

In certain examples, a food processing machine for processing a food product includes a housing defining a cavity, a conveyor with a belt comprising metal for conveying the food product through the cavity in a longitudinal direction, and a convection heating system for heating air in the cavity such that heated air heats the food product as the food product is conveyed through the cavity. A microwave launch box system is configured to emit microwave energy into the cavity in a lateral direction transverse to the longitudinal direction to thereby further heat the food product as the food product is conveyed through the cavity.

In certain examples, the belt is a continuous belt that is continuously conveyed through the cavity. In certain examples, the machine has a microwave launch box section into which the microwave launch box system emits microwave energy to thereby heat the food product. The microwave energy comprising an electric field component and a magnetic field component, and the magnetic field component propagates in the lateral direction along the belt to thereby heat the food product. The housing has a first sidewall and a second opposite sidewall that each extend in the longitudinal direction along the conveyor, and the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall. The first launch box assembly is aligned with the second launch box assembly in the vertical direction and the longitudinal direction. The first sidewall has a first opening and the second sidewall has a second opening. The first launch box assembly emits microwave energy through the first opening into the cavity and the second launch box assembly emits microwave energy through the second opening into the cavity.

In certain examples, the first launch box assembly has a match plate coupled to the first sidewall and positioned in the cavity to thereby couple resonant modes of the microwave energy emitting from the first launch box assembly and the second launch box assembly has a match plate coupled to the second sidewall and positioned in the cavity to thereby couple resonant modes of the microwave energy emitting from the second launch box assembly. The match plate of the first launch box assembly is spaced apart from match plate of the first launch box assembly by a first lateral distance to thereby minimize cross-coupling effects of the microwave energy emitted by the first launch box assembly and the second launch box assembly. The microwave energy has a wavelength, and the first lateral distance equals five wavelengths.

In certain examples, the first launch box assembly and the second launch box assembly each have four identical waveguides and a magnetron coupled to each waveguide. The magnetrons produce the microwave energy and the waveguides direct the microwave energy into the cavity. The first launch box assembly has a choke plate coupled to the first sidewall to cover the first opening and prevent leakage of the microwave energy at the first sidewall. The second launch box assembly has a choke plate coupled to the second sidewall to cover the second opening and prevent leakage of the microwave energy at the second sidewall. The choke plate of the first launch box assembly has a choke channel that encircles the first opening and the choke channel has a centerline spaced apart from the first opening at a distance of one-quarter wavelength to thereby form impedance suppression that prevents leakage of the microwave energy from the first opening. The choke plate of the second launch box assembly has a choke channel encircling the second opening and the choke channel has a centerline spaced apart from the second opening at a distance of one-quarter wavelength to thereby form impedance suppression that prevents leakage of the microwave energy from the second opening.

In certain examples, the housing has an upstream endwall with an opening through which the belt extends and the food product is received into the cavity and a downstream endwall with an opening through which the belt extends and the food product is dispensed from the cavity. An upper choke assembly is positioned vertically above the belt and a lower choke assembly is positioned vertically below the belt at the opening in the upstream endwall and the opening in the downstream endwall to thereby prevent the microwave energy from leaking through the opening in the upstream endwall and the opening in the downstream endwall. In certain examples, the upper choke assembly and the lower choke assembly has a width of one-quarter wavelength. A perforated panel assembly with a first plurality of perforated panels positioned vertically above the conveyor and second plurality of panels positioned vertically below the conveyor to thereby absorb microwave energy or deflect microwave energy toward the conveyor and the food product and prevent leakage of the microwave energy out of the cavity. The first plurality of perforated panels and the second plurality of perforated panels permit the passage of air therethrough such that the food product is cooked by convection.

In certain examples, the microwave launch box system further includes a third launch box assembly coupled to the first sidewall for emitting microwave energy in the lateral direction toward the second sidewall. The third launch box assembly has a match plate spaced apart from the match plate of the first launch box assembly by a first longitudinal distance to thereby minimize cross-coupling effects of the microwave energy emitted by the third launch box assembly and the first launch box assembly. In certain examples, the microwave launch box system further includes machine a fourth launch box assembly coupled to the second sidewall for emitting microwave energy in the lateral direction toward the first sidewall. The fourth launch box assembly has a match plate spaced apart from the match plate of the second launch box assembly by the first longitudinal distance to thereby minimize cross-coupling effects of the microwave energy emitted by the fourth launch box assembly and the second launch box assembly. The third launch box assembly is aligned with the fourth launch box assembly in the vertical direction and the longitudinal direction. In certain examples, the first longitudinal distance equals five wavelengths.

In certain examples, the convection heating system includes a heating element configured to heat the air within the cavity and a fan configured to convey the heated air within the cavity in a circuitous path such that the food product is heated. In certain examples, the first launch box assembly has a magnetron for producing the microwave energy emitted into the cavity, and the second launch box assembly has a magnetron for producing the microwave energy emitted into the cavity. In certain examples, a controller is in communication with and for controlling the magnetron of the first launch box assembly and the magnetron of the second launch box assembly such that the controller can selectively activate the magnetron of the first launch box assembly and the magnetron of the second launch box. In certain examples, a microwave monitoring detector for detecting microwave energy leaking from the oven is included. The controller is in communication with the microwave monitoring detector and is configured to shut off at least one of the launch box assemblies or magnetrons when the microwave energy detected by the microwave monitoring detector is equal to or greater than a maximum allowable microwave energy leakage value. In certain examples, hoods are positioned adjacent to the opening in the first endwall and the opening in the second endwall to absorb the microwave energy that may leak through the openings.

In certain examples, a food processing machine for processing a food product includes a housing with a cavity, a first sidewall extending in a longitudinal direction and having a first opening therein, a second sidewall opposite the first sidewall and extending in the longitudinal direction and having a second opening therein, an upstream end wall with an opening through which the food product is received into the cavity, and a downstream end wall with an opening through which the food product is dispensed from the cavity. The upstream endwall and the downstream endwall each extend in a lateral direction transverse to the longitudinal direction. A conveyor with a belt comprising metal extends through the opening in the upstream end wall and the opening in the downstream end wall and is for conveying the food product through the cavity in the longitudinal direction. A convection heating system heats air in the cavity such that the heated air cooks the food product as the food product is conveyed through the cavity, and a microwave launch box system emits microwave energy into the cavity to thereby further heat the food product as the food product is conveyed through the cavity. The microwave launch box system has a first launch box assembly coupled to the first sidewall that directs microwave energy in a lateral direction through the first opening toward the second sidewall and a second launch box assembly coupled to the second sidewall that directs microwave energy in the lateral direction through the second opening and toward the first sidewall. The first launch box assembly has a choke plate coupled to the first sidewall that prevents leakage of the microwave energy from the first opening, and the second launch box assembly has a choke plate coupled to the second sidewall that prevents leakage of the microwave energy from the second opening.

In certain examples, the choke plate of the first microwave launch box has a choke channel encircling the first opening and the choke channel has a centerline spaced apart from the first opening at a distance of one-quarter wavelength to thereby form an impedance suppression that prevents leakage of the microwave energy from the first opening. The choke plate of the second launch box assembly has a choke channel encircling the second opening, and the choke channel has a centerline spaced apart from the second opening at a distance of one-quarter wavelength to thereby form an impedance suppression that prevents leakage of the microwave energy from the second opening. In certain examples, an upper choke assembly is vertically above the belt and a lower choke assembly vertically is below the belt at the opening in the upstream end wall and the opening in the downstream end wall to thereby prevent microwave energy from leaking through the opening in the upstream end wall and the opening in the downstream end wall. The upper choke assembly and the lower choke assembly each have a width of one-quarter wavelength.

In certain examples, a perforated panel assembly with a first plurality of perforated panels positioned vertically above the conveyor and second plurality of panels positioned vertically below the conveyor is included. The first plurality of perforated panels and the second plurality of perforated panels absorb microwave energy or deflect microwave energy toward the conveyor and the food product and prevent leakage of the microwave energy out of the cavity. The first plurality of perforated panels and the second plurality of perforated panels permit the passage of air therethrough such that the food product is cooked by the heated air convection.

What is claimed is:

1. A food processing machine for processing a food product, the food processing machine comprising:

a housing defining a cavity;

a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity; and a microwave launch box system configured to emit microwave energy into the cavity in a lateral direction transverse to the longitudinal direction to thereby further heat the food product as the food product is conveyed through the cavity;

a microwave launch box section into which the microwave launch box system emits microwave energy to thereby heat the food product;

wherein the microwave energy comprises an electric field component and a magnetic field component, and wherein the magnetic field component propagates in the lateral direction along the belt to thereby heat the food product.

2. The food processing machine according to claim 1, wherein the housing has a first sidewall and a second opposite sidewall that each extend in the longitudinal direction along the conveyor; and wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall.

3. The food processing machine according to claim 2, wherein the first launch box assembly is aligned with the second launch box assembly in the vertical direction and the longitudinal direction.

4. The food processing machine according to claim 3, wherein the first sidewall has a first opening and the second sidewall has a second opening; and wherein the first launch box assembly emits microwave energy through the first opening into the cavity and the second launch box assembly emits microwave energy through the second opening into the cavity.

5. The food processing machine according to claim 2, wherein the first launch box assembly has a magnetron for producing the microwave energy emitted into the cavity, and the second launch box assembly has a magnetron for producing the microwave energy emitted into the cavity, and the food processing machine further comprises:

a controller in communication with and for controlling the magnetron of the first launch box assembly and the magnetron of the second launch box assembly such that the controller can selectively activate the magnetron of the first launch box assembly and the magnetron of the second launch box assembly.

6. A food processing machine for processing a food product, the food processing machine comprising:

a housing defining a cavity;

a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity; and a microwave launch box system configured to emit microwave energy into the cavity in a lateral direction transverse to the longitudinal direction to thereby further heat the food product as the food product is conveyed through the cavity;

a microwave launch box section into which the microwave launch box system emits microwave energy to thereby heat the food product;

wherein the housing has a first sidewall and a second opposite sidewall that each extend in the longitudinal direction along the conveyor;

wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall;

wherein the first launch box assembly is aligned with the second launch box assembly in the vertical direction and the longitudinal direction;

wherein the first launch box assembly has a match plate coupled to the first sidewall and positioned in the cavity to thereby couple resonant modes of the microwave energy emitting from the first launch box assembly;

wherein the second launch box assembly has a match plate coupled to the second sidewall and positioned in the cavity to thereby couple resonant modes of the microwave energy emitting from the second launch box assembly; and wherein the match plate of the first launch box assembly is spaced apart from the match plate of the second first launch box assembly by a first lateral distance to thereby minimize cross-coupling effects of the microwave energy emitted by the first launch box assembly and the second launch box assembly.

7. The food processing machine according to claim 6, wherein the microwave energy has a wavelength, and wherein the first lateral distance equals five wavelengths.

8. A food processing machine for processing a food product, the food processing machine comprising:

a housing defining a cavity;

a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity;

a microwave launch box system configured to emit microwave energy into the cavity in a lateral direction transverse to the longitudinal direction to thereby further heat the food product as the food product is conveyed through the cavity;

a microwave launch box section into which the microwave launch box system emits microwave energy to thereby heat the food product;

wherein the housing has a first sidewall and a second opposite sidewall that each extend in the longitudinal direction along the conveyor;

wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall;

wherein the first launch box assembly is aligned with the second launch box assembly in the vertical direction and the longitudinal direction;

wherein the first sidewall has a first opening and the second sidewall has a second opening; and wherein the first launch box assembly emits microwave energy through the first opening into the cavity and the second launch box assembly emits microwave energy through the second opening into the cavity;

wherein the first launch box assembly and the second launch box assembly each have four identical waveguides and a magnetron coupled to each waveguide, and wherein the magnetrons produce the microwave energy and the waveguides direct the microwave energy into the cavity.

9. The food processing machine according to claim 8, wherein the first launch box assembly has a choke plate coupled to the first sidewall to cover the first opening and prevent leakage of the microwave energy at the first sidewall; and wherein the second launch box assembly has a choke plate coupled to the second sidewall to cover the second opening and prevent leakage of the microwave energy at the second sidewall.

10. The food processing machine according to claim 9, wherein the choke plate of the first launch box assembly has a choke channel encircling the first opening and the choke channel has a centerline spaced apart from the first opening at a distance of one-quarter wavelength to thereby form impedance suppression that prevents leakage of the microwave energy from the first opening; and wherein the choke plate of the second launch box assembly has a choke channel encircling the second opening and the choke channel has a centerline spaced apart from the second opening at a distance of one-quarter wavelength to thereby form impedance suppression that prevents leakage of the microwave energy from the second opening.

11. The food processing machine according to claim 8, wherein the convection heating system includes a heating element configured to heat the air within the cavity and a fan configured to convey the heated air within the cavity in a circuitous path such that the food product is heated.

12. A food processing machine for processing a food product, the food processing machine comprising:

a housing defining a cavity, a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity;

a microwave launch box system configured to emit microwave energy into the cavity in a lateral direction transverse to the longitudinal direction to thereby further heat the food product as the food product is conveyed through the cavity;

wherein the food processing machine has a microwave launch box section into which the microwave launch box system emits microwave energy to thereby heat the food product;

wherein the housing has a first sidewall and a second opposite sidewall that each extend in the longitudinal direction along the conveyor;

wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall;

wherein the first launch box assembly is aligned with the second launch box assembly in the vertical direction and the longitudinal direction;

wherein the first sidewall has a first opening and the second sidewall has a second opening; and wherein the first launch box assembly emits microwave energy through the first opening into the cavity and the second launch box assembly emits microwave energy through the second opening into the cavity; and wherein the housing has an upstream endwall with an opening through which the belt extends and the food product is received into the cavity and a downstream endwall with an opening through which the belt extends and the food product is dispensed from the cavity; and the food processing machine further comprises:

an upper choke assembly vertically above the belt and a lower choke assembly vertically below the belt at the opening in the upstream endwall and the opening in the downstream endwall to thereby prevent the microwave energy from leaking through the opening in the upstream endwall and the opening in the downstream endwall.

13. The food processing machine according to claim 12, wherein each of the upper choke assemblies and the lower choke assemblies has a width of one-quarter wavelength.

14. The food processing machine according to claim 13, further comprising a perforated panel assembly with a first plurality of perforated panels positioned vertically above the conveyor and a second plurality of perforated panels positioned vertically below the conveyor to thereby absorb microwave energy or deflect microwave energy toward the conveyor and the food product and prevent leakage of the microwave energy out of the cavity.

15. The food processing machine according to claim 14, wherein the first plurality of perforated panels and the second plurality of perforated panels permit the passage of air therethrough such that the food product is cooked by convection.

16. The food processing machine according to claim 14, further comprising hoods positioned adjacent to the opening in the first endwall and the opening in the second endwall to absorb the microwave energy that may leak through the openings.

17. A food processing machine for processing a food product, the food processing machine comprising:

a housing defining a cavity, a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity;

a microwave launch box system configured to emit microwave energy into the cavity in a lateral direction transverse to the longitudinal direction to thereby further heat the food product as the food product is conveyed through the cavity;

wherein the food processing machine has a microwave launch box section into which the microwave launch box system emits microwave energy to thereby heat the food product;

wherein the housing has a first sidewall and a second opposite sidewall that each extend in the longitudinal direction along the conveyor; and wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall;

wherein the first launch box assembly is aligned with the second launch box assembly in the vertical direction and the longitudinal direction;

wherein the first sidewall has a first opening and the second sidewall has a second opening; and wherein the first launch box assembly emits microwave energy through the first opening into the cavity and the second launch box assembly emits microwave energy through the second opening into the cavity; and wherein the microwave launch box system further includes:

a third launch box assembly coupled to the first sidewall for emitting microwave energy in the lateral direction toward the second sidewall, the third launch box assembly has a match plate spaced apart from the match plate of the first launch box assembly by a first longitudinal distance to thereby minimize cross-coupling effects of the microwave energy emitted by the third launch box assembly and the first launch box assembly; and a fourth launch box assembly coupled to the second sidewall for emitting microwave energy in the lateral direction toward the first sidewall, the fourth launch box assembly has a match plate spaced apart from the match plate of the second launch box assembly by the first longitudinal distance to thereby minimize cross-coupling effects of the microwave energy emitted by the fourth launch box assembly and the second launch box assembly.

18. The food processing machine according to claim 17, wherein the third launch box assembly is aligned with the fourth launch box assembly in the vertical direction and the longitudinal direction.

19. The food processing machine according to claim 18, wherein the first longitudinal distance equals five wavelengths.

20. A food processing machine for processing a food product, the food processing machine comprising:

a housing defining a cavity;

a conveyor with a belt comprising metal for conveying the food product through the cavity in a longitudinal direction, wherein the belt is a continuous belt that is continuously conveyed through the cavity;

a convection heating system for heating air in the cavity such that heated air heats the food product as the food product is conveyed through the cavity; and a microwave launch box system configured to emit microwave energy into the cavity in a lateral direction transverse to the longitudinal direction to thereby further heat the food product as the food product is conveyed through the cavity;

a microwave launch box section into which the microwave launch box system emits microwave energy to thereby heat the food product;

wherein the housing has a first sidewall and a second opposite sidewall that each extend in the longitudinal direction along the conveyor;

wherein the microwave launch box system includes a first launch box assembly that is coupled to the first sidewall and directs microwave energy in the lateral direction toward the second sidewall and a second launch box assembly that is coupled to the second sidewall and directs microwave energy in the lateral direction toward the first sidewall;

wherein the first launch box assembly has a magnetron for producing the microwave energy emitted into the cavity, and the second launch box assembly has a magnetron for producing the microwave energy emitted into the cavity; and a controller in communication with and for controlling the magnetron of the first launch box assembly and the magnetron of the second launch box assembly such that the controller can selectively activate the magnetron of the first launch box assembly and the magnetron of the second launch box; and a microwave monitoring detector for detecting microwave energy leaking from the oven; and wherein the controller is in communication with the microwave monitoring detector and is configured to shut off at least one of the launch box assemblies or magnetrons when the microwave energy detected by the microwave monitoring detector is equal to or greater than a maximum allowable microwave energy leakage value.

21. A food processing machine for processing a food product, the food processing machine comprising:

a housing including:

a cavity;

a first sidewall extending in a longitudinal direction and having a first opening therein;

a second sidewall opposite the first sidewall and extending in the longitudinal direction and having a second opening therein;

an upstream endwall with an opening through which the food product is received into the cavity;

a downstream endwall with an opening through the food product is dispensed from the cavity, the upstream endwall and the downstream endwall each extend in a lateral direction transverse to the longitudinal direction;

a conveyor with a belt comprising metal extends through the opening in the upstream endwall and the opening in the downstream endwall and is for conveying the food product through the cavity in the longitudinal direction;

a convection heating system heats air in the cavity such that the heated air cooks the food product as the food product is conveyed through the cavity; and a microwave launch box system emits microwave energy into the cavity to thereby further heat the food product as the food product is conveyed through the cavity, the microwave launch box system has:

a first launch box assembly coupled to the first sidewall that directs microwave energy in a lateral direction through the first opening toward the second sidewall, the first launch box assembly has a choke plate coupled to the first sidewall that prevents leakage of the microwave energy from the first opening;

a second launch box assembly coupled to the second sidewall for directing microwave energy in a lateral direction through the second opening and toward the first sidewall, the second launch box assembly has a choke plate coupled to the second sidewall that prevents leakage of the microwave energy from the second opening;

wherein the choke plate of the first launch box assembly has a choke channel encircling the first opening, the choke channel has a centerline spaced apart from the first opening at a distance of one-quarter wavelength to thereby form an impedance suppression that prevents leakage of the microwave energy from the first opening; and wherein the choke plate of the second launch box assembly has a choke channel encircling the second opening, the choke channel has a centerline spaced apart from the second opening at a distance of one-quarter wavelength to thereby form an impedance suppression that prevents leakage of the microwave energy from the second opening.

22. The food processing machine according to claim 21, further comprising an upper choke assembly vertically above the belt and a lower choke assembly vertically below the belt at the opening in the upstream endwall and the opening in the downstream endwall to thereby prevent microwave energy from leaking through the opening in the upstream endwall and the opening in the downstream endwall.

23. The food processing machine according to claim 22, wherein each of the upper choke assemblies and the lower choke assemblies has a width of one-quarter wavelength.

24. The food processing machine according to claim 23, further comprising a perforated panel assembly with a first plurality of perforated panels positioned vertically above the conveyor and a second plurality of perforated panels positioned vertically below the conveyor to thereby absorb microwave energy or deflect microwave energy toward the conveyor and the food product and prevent leakage of the microwave energy out of the cavity.

25. The food processing machine according to claim 24, wherein the first plurality of perforated panels and the second plurality of perforated panels permit the passage of air therethrough such that the food product is cooked by the heated air and convection.

* * * * *